US006128877A

United States Patent [19]

Goodman et al.

[11] Patent Number: 6,128,877

[45] Date of Patent: Oct. 10, 2000

[54] VARIABLE WIDTH END PANEL

[75] Inventors: Steven F. Goodman, Wyoming; Roy W. Fink, Portage; Allen C. Hager; James D. Houda, both of Grand Rapids; Michael H. Abson, Lowell, all of Mich.

[73] Assignee: Steelcase Development Inc., Grand Rapids, Mich.

[21] Appl. No.: 09/037,840

[22] Filed: Mar. 10, 1998

[51] Int. Cl.[7] ..... E04H 1/00

[52] U.S. Cl. ..... 52/242; 52/36.1; 52/220.7; 52/239; 52/243; 52/271; 52/481.2; 52/745.1; 160/135; 160/351; 312/223.3; 403/297

[58] Field of Search ..... 52/220.7, 238.1, 52/239, 242, 243, 284, 281, 271, 582.2, 584.1, 36.1, 481.2, 489.1, 126.3, 285.1, 745.09, 745.1; 403/230, 240, 247, 257, 258, 256, 297, 321, 322, 338, 363, 385, 362, 403; 312/223.3; 160/135, 351

[56] References Cited

U.S. PATENT DOCUMENTS

| | | |
|---|---|---|
| 3,013,642 | 12/1961 | Hammitt et al. . |
| 3,066,770 | 12/1962 | Millard et al. . |
| 3,125,785 | 3/1964 | Conville . |
| 3,160,248 | 12/1964 | Galajikian . |
| 3,368,312 | 2/1968 | Shore . |
| 3,425,568 | 2/1969 | Albright . |
| 3,514,883 | 6/1970 | Albright . |
| 3,722,157 | 3/1973 | Prokop . |
| 3,948,011 | 4/1976 | Price et al. . |
| 4,028,855 | 6/1977 | Prewer . |
| 4,461,135 | 7/1984 | Anderson et al. . |
| 4,497,150 | 2/1985 | Wendt et al. . |
| 4,619,486 | 10/1986 | Hannah et al. . |

(List continued on next page.)

OTHER PUBLICATIONS

Exhibit A is a brochure entitled *Knoll—Hannah Desk System*, 18 pages, dated Oct. 1986.

Exhibit B is a brochure entitled *Knoll—Hannah Desk System*, 13 pages, undated but published in 1986.

Exhibit C is a publication entitled *Knoll—Hannah Desk System—Electrical Assembly Guide*, (12 pages), undated but published in 1986.

Exhibit D is a publication entitled *Knoll—Hannah Desk System—Assembly Guide*, 12 pages, undated but published in 1986.

*Primary Examiner*—Carl D. Friedman
*Assistant Examiner*—Yvonne M. Horton
*Attorney, Agent, or Firm*—Price, Heneveld, Cooper, DeWitt & Litton

[57] ABSTRACT

A variable width panel includes a frame having a knock-down construction adapted for on-site assembly. The frame includes a first rigid stile adapted to be disposed in a generally vertical assembled orientation along a first side of the frame. At least two rigid cross-members having first ends thereof rigidly attached to the stile are disposed in a vertically spaced-apart relationship, and extend in a generally horizontal assembled orientation. The cross-members having predetermined full width with a construction which permits the cross-members to be cut to a custom width at a second end thereof during the on-site assembly for use in a special width panel that is adapted for connection with the standard width panels. The frame also includes fasteners for detachably connecting the second ends of the cross-members with the second stile to define a pocket therebetween. The panel kit further includes a core panel shaped to be received in the pocket, and having a predetermined full width with a construction which permits the core panel to be cut to a custom width during the on-site assembly for use in the special width panel. The variable width panel kit further includes at least one cover panel configured to be detachably mounted on the frame, and enclose an associated portion of the same. The cover panel has a predetermined full width with a construction which permits the cover panel to be cut to a custom width during the on-site assembly for use in the special width panel.

69 Claims, 16 Drawing Sheets

U.S. PATENT DOCUMENTS

| | | | |
|---|---|---|---|
| 4,716,692 | 1/1988 | Harper et al. | 52/36 |
| 4,798,035 | 1/1989 | Mitchell et al. . | |
| 4,869,037 | 9/1989 | Murphy | 52/238.1 |
| 4,883,330 | 11/1989 | Armstrong et al. . | |
| 5,038,539 | 8/1991 | Kelly et al. | 52/239 |
| 5,056,285 | 10/1991 | Frascaroli et al. | 52/243 |
| 5,060,434 | 10/1991 | Allison . | |
| 5,117,599 | 6/1992 | Voss | 52/238.1 |
| 5,125,202 | 6/1992 | Kissinger | 52/239 |
| 5,175,969 | 1/1993 | Knauf et al. . | |
| 5,209,035 | 5/1993 | Hodges et al. | 52/220.7 |
| 5,309,686 | 5/1994 | Underwood et al. | 52/29 |
| 5,363,612 | 11/1994 | Erickson | 52/239 |
| 5,377,461 | 1/1995 | De Grada et al. | 52/126.4 |
| 5,377,466 | 1/1995 | Insalaco et al. | 52/238.1 |
| 5,406,760 | 4/1995 | Edwards | 52/239 |
| 5,433,046 | 7/1995 | Mac Quarrie et al. | 52/238.1 |
| 5,487,246 | 1/1996 | Hodges et al. | 52/220.7 |
| 5,675,946 | 10/1997 | Verbeek et al. | 52/205 |
| 5,740,650 | 4/1998 | Seiber et al. . | |
| 5,743,054 | 4/1998 | Luchetti et al. . | |
| 5,746,034 | 5/1998 | Luchetti et al. . | |
| 5,746,035 | 5/1998 | Seiber et al. . | |
| 5,813,177 | 9/1998 | Wu | 52/238.1 |
| 5,813,178 | 9/1998 | Edwards | 52/239 |
| 5,873,205 | 2/1999 | Hanlon et al. | 52/239 |

36
53
54
52
55
28
29
27
51
58
55
15
21
13
50
56
57
22
169
8
6
169
56
8
16
7
2
169
23
169
58
9
17
50
56
37
169
24
10
3
56
25
169
18
169
45
56
19
26
11
162
20
46
37
4
44

Fig. 13
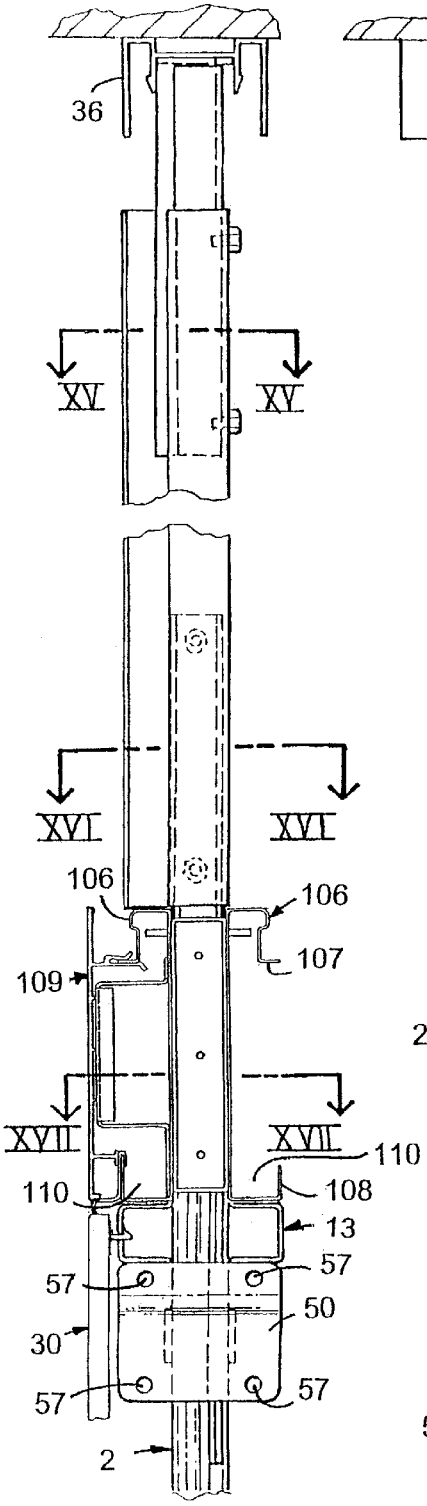
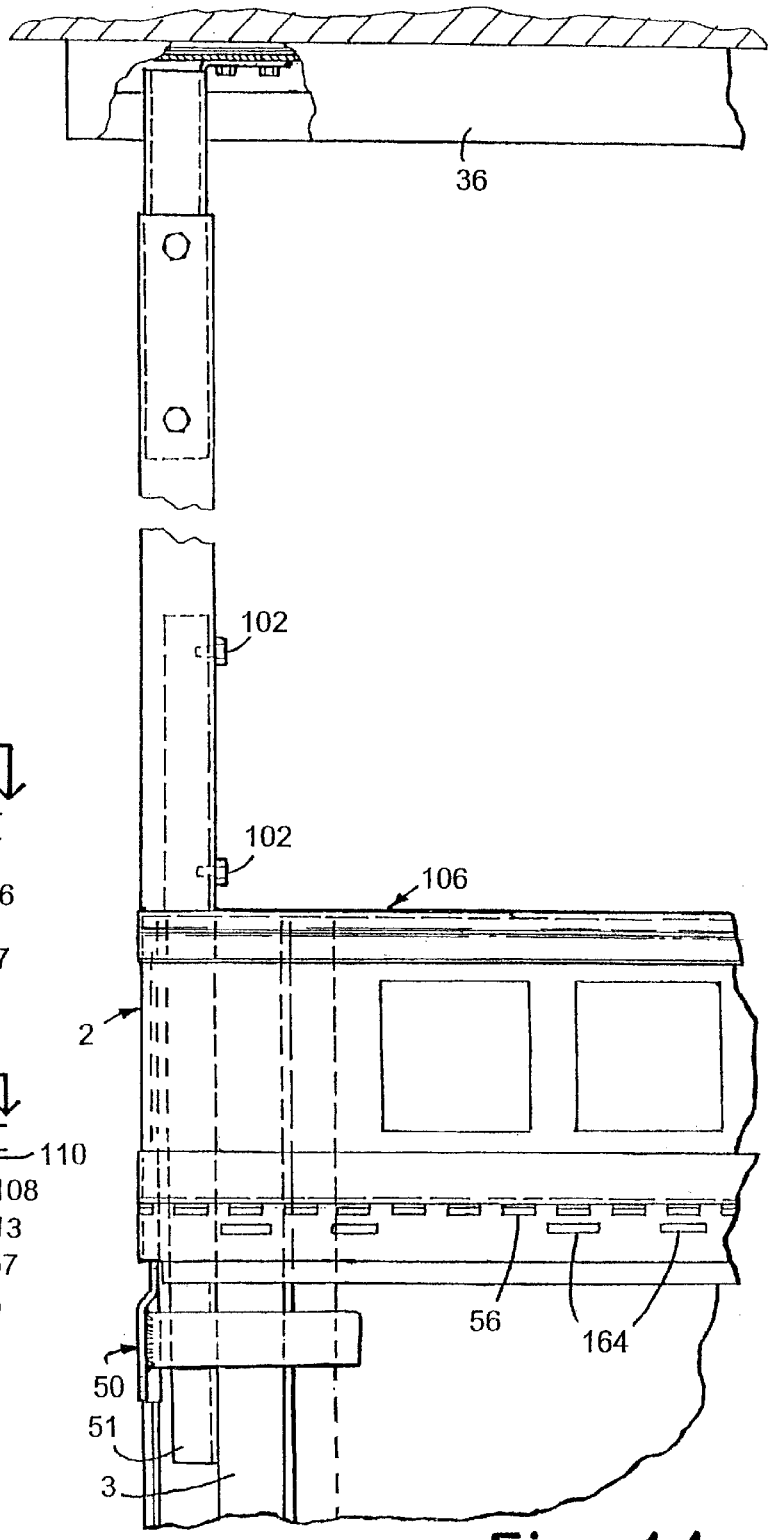
Fig. 14

VARIABLE WIDTH END PANEL

CROSS-REFERENCES TO RELATED APPLICATIONS

The present application is related to the following, commonly assigned, copending U.S. patent applications, which are hereby incorporated herein by reference.

| application Ser. No. | Filing Date | Title |
|---|---|---|
| 09/037,476 | Filed on Even Date Herewith | CLEAR WALL PANEL SYSTEM |
| 09/038,371 Now U.S. Pat. No. 6,047,508 | Filed on Even Date Herewith | WALL PANEL PARTITION SYSTEM |
| 09/037,478 Now U.S. Pat. No. 6,058,665 | Filed on Even Date Herewith | ADJUSTABLE DOORWAY STRUCTURE |
| 09/038,370 | Filed on Even Date Herewith | OVERHEAD STRUCTURES FOR WALL SYSTEM |
| 09/005,428, Now U.S. Pat. No. 6,000,180 | January 9, 1998 | PARTITION SYSTEM WITH REMOVABLE COVER PANELS |
| 08/367,804, now U.S. Pat. No. 5,784,843 | December 30, 1994 | INTEGRATED PRE-FABRICATED FURNITURE SYSTEM FOR FITTING-OUT OPEN PLAN BUILDING SPACE |
| 08/579,614, Now U.S. Pat. No. 5,746,035 | December 26, 1995 | PARTITION SYSTEM |

BACKGROUND OF THE INVENTION

The present invention relates to the finishing or fitting-out of building space and the like of the type having a generally open plan interior, and in particular to a variable width wall panel that is readily fitted at the installation site.

The finishing or fitting-out of building spaces for offices, medical treatment facilities, and other areas where work is conducted has become a very important aspect of effective space planning and layout. Work patterns, technology, and business organizations are constantly evolving and changing. The building space users require products which facilitate change at lower cost, yet provide the privacy and aesthetic advantages of permanent floor-to-ceiling architectural wall systems. Space planning is no longer a static problem. Changing technology and changing work processes demand that a design and installation be able to support and anticipate change.

These space planning challenges are driven largely by the fact that modern office spaces are becoming increasingly more complicated and sophisticated due to increasing needs of the users for improved utilities support at each workstation or work setting. These "utilities," as the term is used herein, encompass all types of resources that may be used to support or service a worker, such as communications and data used with computers and other types of data processors, telecommunications, electronic displays, etc., electrical power, conditioned water, and physical accommodations, such as lighting, HVAC, sprinklers, security, sound masking, and the like. For example, modern offices for highly skilled "knowledge workers" such as engineers, accountants, stock brokers, computer programmers, etc., are typically provided with multiple pieces of very specialized computer and communications equipment that are capable of processing information from numerous local and remote data resources to assist in solving complex problems. Such equipment has very stringent power and signal requirements, and must quickly and efficiently interface with related equipment at both adjacent and remote locations. Work areas with readily controllable lighting, HVAC, sound masking, and other physical support systems, are also highly desirable to maximize worker creativity and productivity. Many other types of high technology equipment and facilities are also presently being developed which will need to be accommodated in the work places of the future.

The efficient use of building floor space is also an ever-growing concern, particularly as building costs continue to escalate. Open office plans have been developed to reduce overall office costs, and generally incorporate large, open floor spaces in buildings that are equipped with modular furniture systems, which are readily reconfigurable to accommodate the ever-changing needs of a specific user, as well as the divergent requirements of different tenants. One arrangement commonly used for furniture open plans includes movable partial height partition panels that are detachably interconnected to partition off the open spaces into individual work settings and/or offices. Such partial height partition panels are configured to receive hang-on furniture units, such as worksurfaces, overhead cabinets, shelves, etc., and are generally known in the office furniture industry as "systems furniture." Another arrangement for dividing and/or partitioning open plans involves the use of modular furniture, in which a plurality of differently shaped, complementary freestanding furniture units are positioned in a side-by-side relationship, with upstanding partial height privacy screens available to attach to selected furniture units to create individual, distinct work settings and/or offices. All of these types of modular furniture systems have been widely received due largely to their ability to be readily reconfigured and/or moved to a new site, since they are not part of a permanent leasehold improvement.

In order to gain increased efficiency in the use of expensive office real estate, attempts are now being made to try to support highly paid knowledge workers with these types of modular furniture systems in open office settings, instead of conventional private offices. However, in order to insure peak efficiency of such knowledge workers, the work settings must be equipped with the various state-of-the-art utilities and facilities discussed above. Since such work settings must be readily reconfigurable to effectively meet the ever-changing needs of the use, the distribution and control of utilities throughout a comprehensive open office plan has emerged as a major challenge to the office furniture industry. The inherent nature of modular furniture systems, which permits them to be readily reconfigurable into different arrangements, makes it very difficult to achieve adequate utility distribution and control.

Today's office workers need new flexible alternative products for the creation of individual and collaborative spaces which allow the expression of the cultural aims of the organization, express the creativity of the designer, provide a "sense of place" for the users, and provide a competitive edge for the developer. These needs include a full range of privacy options, from fully enclosed offices which support individual creative work to open spaces for collaborative team work. The products must also be able to accommodate diverse organizations, unique design signatures, and constantly changing work processes. Workers also need effective lighting, better air quality, life safety, and ergonomic task support to promote productivity, minimize the expenses of absenteeism and workman's compensation, and reduce potential liability, which collectively make the building more desirable to prospective clients.

Hence, utility distribution and control are fast becoming one of the major issues in office fit-out and furniture. Changing technology is creating greater demands on power and signal distribution networks. As businesses become more aware of the impact of proper ventilation and climate control on employee health and performance, HVAC is becoming more important as well. The current disposition of HVAC, lighting, and fire protection in the ceiling creates a separation between these services and the work settings below leading to inefficient and inaccurate systems. routing power and signal distribution below the floor or in furniture systems often ends up in complex idiosyncratic systems which are difficult to manage or change.

Due to dimension variations in existing permanent building walls, ceiling, and floors, space-dividing systems must be adaptable to accommodate these variables. Meeting the varied requirements of particular office workers often requires a combination of full and partial height dividers. However, presently available full height architectural walls are not readily reconfigurable. In addition, available full height architectural dividers are not readily interconnected with partial height partition panels, and also do not provide integrated utility distribution between the various types of dividers in the office space.

Furthermore, if a series of partition panels are interconnected to form a partition wall, the wall has an overall length which is a multiple of the individual panel widths. Accordingly, if the space to be divided does not correspond to standard width panels, considerable difficulty may be encountered if a special width panel must be ordered from the manufacturer. Accordingly, the custom width panel of the present invention is easily adjusted on-site by the installer, and eliminates the expense and delay associated with a prefabricated custom width panel.

There is presently an oversupply of office space and furniture systems which do not properly respond to or support change. Many older buildings do not have adequate utility capabilities, and the cost of conventional renovations or improvements often renders the same impractical. Even relatively new buildings can be quickly rendered obsolete by the fast paced changes in modern technology. The refurbishing of existing building space is herefore a concern which must be addressed by furniture systems.

SUMMARY OF THE INVENTION

One aspect of the present invention is to provide a variable width panel kit for reconfigurable office partitions and the like of the type having a plurality of prefabricated standard width panels interconnected to define a partition wall. The variable width panel includes a frame having a knock-down construction adapted for on-site assembly. The frame includes a first rigid stile adapted to be disposed in a generally vertical assembled orientation along a first side of the frame. At least two rigid cross-members having first ends thereof rigidly attached to the stile are disposed in a vertically spaced-apart relationship, and extend in a generally horizontal assembled orientation. The cross-members having predetermined full width with a construction which permits the cross-members to be cut to a custom width at a second end thereof during the on-site assembly for use in a special width panel that is adapted for connection with the standard width panels. The frame also includes fasteners for detachably connecting the second ends of the cross-members with the second stile to define a pocket therebetween. The panel kit further includes a core panel shaped to be received in the pocket, and having a predetermined full width with a construction which permits the core panel to be cut to a custom width during the on-site assembly for use in the special width panel. The variable width panel kit further includes at least one cover panel configured to be detachably mounted on the frame, and enclose an associated portion of the same. The cover panel has a predetermined full width with a construction which permits the cover panel to be cut to a custom width during the on-site assembly for use in the special width panel.

Another aspect of the present invention is a reconfigurable office partition system having a plurality of prefabricated standard width panels interconnected to define a wall which extends along at least a portion of a predetermined wall length, wherein the balance of the predetermined wall length creates a space having a width less than the width of one of the standard width panels. The improvement of a variable width panel in the space, the variable width panel including a frame having a knock-down construction for on-site assembly. The frame includes at least two rigid stiles disposed in a generally vertical assembled orientation along opposite sides of the space and the frame. A frame further includes at least two rigid cross-members extending between the stiles in a vertically spaced-apart, generally horizontal assembled orientation. The cross-members have a predetermined full width with a construction which permits the cross-members to be cut to a custom width during the on-site assembly to define a special width panel connected with at least one of the standard width panels and having a width commensurate with the space. The frame includes fasteners detachably connecting the cross-member with the stiles to define a pocket therebetween. The variable width panel includes a core panel received in the pocket, and having a predetermined full width with a construction which permits the core panel to be cut to a custom width during the on-site assembly for use in the special width panel. The variable width panel includes fasteners that mount the core panel in the frame, and also includes at least one cover panel detachably mounted on the frame, and enclosing an associated portion of the same. The cover panel has a predetermined full width with a construction which permits the cover panel to be cut to a custom width during the on-site assembly for use in the special width panel.

Yet another aspect of the present invention is a variable width panel for use in reconfigurable office partitions and the like of the type having a plurality of prefabricated standard width panels interconnected to define a partition wall which extends along at least a portion of a predetermined wall length, with the balance of the same defining a space having a width less than the width of one of the standard width panels. The variable width panel includes a frame having a knock-down construction for on-site assembly. The frame includes at least two rigid stiles disposed in a generally vertical orientation along opposite sides of the space and the frame. The frame also includes at least two rigid cross-members extending between the stiles in a vertically spaced-apart, generally horizontal orientation. The cross-members have a predetermined full width with a construction which permits the cross-members to be cut to a custom width during the on-site assembly for use in a special width panel having a width commensurate with the space, and being adapted for connection with at least one of the standard width panels. The frame includes fasteners detachably connecting the cross-members with at least one of the stiles to define a pocket therebetween. The variable width panel further includes a core panel received in the pocket, and having a predetermined full width with a construction which permits the core panel to be cut to a custom width during the on-site assembly for use in the special width panel. The variable width panel includes fasteners mounting the core panel in the frame, and at least one cover panel detachably mounted on the frame, and enclosing an associated portion of the same. The cover panel has a predetermined full width with a construction which permits the cover panel to be cut to a custom width during the on-site assembly for use in the special width panel.

Yet another aspect of the present invention is a method for installing reconfigurable office partitions and the like. The method includes providing a plurality of standard width panels. The standard width panels are interconnected to define a wall which extends along at least a portion of a predetermined wall length, wherein the balance of the predetermined wall length is less than the width of one of the standard width panels. A variable width panel that includes a frame having a knock-down construction for adapted for on-site assembly is provided. The frame includes at least two rigid stiles disposed in a generally vertical assembled orientation along opposite sides of the frame, and at least two rigid cross-members having a predetermined full width, and extending between the stiles in a vertically spaced-apart, general horizontal assembled orientation. The method includes cutting the cross-members to a custom width during the on-site assembly for use in a special width panel that connects with the standard width panels. The cross-members are fastened to the stiles to define a pocket therebetween. A core panel having a predetermined full width is provided. The core panel is cut to a custom width during the on-site assembly for use in a special width panel, and the core panel is fastened in the pocket. At least one cover panel having a predetermined full width is provided. The cover panel is cut to a custom width during the on-site assembly for use in the special width panel. The cover panel is removably mounted on the frame to enclosed an associated portion of the same.

Yet another aspect of the present invention is a method for installing a variable width panel in a reconfigurable office partition of the type having a plurality of standard width panels interconnected to define a wall which extends along at least a portion of a predetermined wall length, wherein the balance of the predetermined wall length is less than the width of one of the standard panels. The method includes providing a frame having a knock-down construction adapted for on-site assembly. The frame includes at least two rigid stiles disposed in a generally vertical assembled orientation along opposite sides of the frame, and at least two rigid cross-members having a predetermined full width, and extending between the stiles in a vertically spaced-apart, generally horizontal assembled orientation. The method includes cutting the cross-members to a custom width during the on-site assembly for use in a special width panel that connects with the standard width panels. The cross-members are fastened to the stiles to define a pocket therebetween. A core panel having a predetermined full width is provided. The core panel is cut to a custom width during the on-site assembly for use in the special width panel, and the core panel is fastened in the pocket. At least one cover panel having a predetermined full width is provided, and the cover panel is cut to a custom width during the on-site assembly for use in the special width panel. The cover panel is removably mounted on the frame to enclosed an associated portion of the same.

Yet another aspect of the present invention is a variable width panel kit for reconfigurable office partitions and the like of the type having a plurality of prefabricated standard width panels interconnected to define a partition wall. The variable width panel includes a frame having a knock-down construction adapted for on-site assembly. The frame includes at least two rigid stiles adapted to be disposed in a generally vertical assembled orientation along opposite sides of the frame to define a pocket therebetween. The variable width panel kit also includes a core panel shaped to be received in the pocket. The core panel has a predetermined full width with a construction which permits the core panel to be cut to a custom width during the on-site assembly for use in the special width panel. Fasteners are included for mounting the core panel in the frame. The kit further includes at least one cover panel configured to be detachably mounted on the frame, and enclose an associated portion of the same. The cover panel has a predetermined full width with a construction which permits the cover panel to be cut to a custom width during the on-site assembly for use in the special width panel.

Yet another aspect of the present invention is a variable width panel kit for reconfigurable office partitions and the like of the type having a plurality of prefabricated standard width panels interconnected to define a partition wall. The variable width panel includes a frame having a knock-down construction adapted for on-site assembly. The frame includes a stile adapted to be disposed in a generally vertical assembled orientation along a first side of the frame. The frame further includes a wall track adapted to be disposed in a generally vertical assembled orientation along a second side of the frame to define a pocket between the stile and the wall track. The wall track is adapted for connection with the standard width panels. A core panel is shaped to be received in the pocket, and has a predetermined full width with a construction which permits the core panel to be cut to a custom width during the on-site assembly for use in the special width panel. The kit includes at least one cover panel configured to be detachably mounted on the frame, and enclose an associated portion of the same. The cover panel has a predetermined full width with a construction which permits the cover panel to be cut to a custom width during the on-site assembly for use in the special width panel. The kit includes an elongated retainer adapted to be removably connected to the wall track and extend therealong. The retainer has an outer portion extending over an edge of the cover panel to retain the same to the frame when in an assembled condition.

Yet another aspect of the present invention is a cover panel for covering a variable width panel frame including a panel member defining a quadrilateral perimeter with an upper edge, and a downwardly-extending flange defining a lower edge. The flange is connected to the panel member and extends along the upper edge thereof. The cover panel has a predetermined full width with a construction which permits the cover panel to be cut to a custom width during on-site assembly for covering at least a portion of the variable width panel frame. The cover panel includes a hanger having a pair of oppositely opening hooks, with a first hook engaging the lower edge of the flange, and a second hook shaped to engage the variable width panel frame to support the cover panel adjacent a cut edge thereof.

These and other features, advantages and objects of the present invention will be further understood and appreciated by those skilled in the art by reference to the following specification, claims and appended drawings.

BRIEF DESCRIPTION OF THE DRAWINGS

FIG. 13 is a fragmentary, side elevational view of an upper portion of the panel frame;

FIG. 14 is a fragmentary, front elevational view of an upper portion of the panel frame;

DETAILED DESCRIPTION OF PREFERRED EMBODIMENT

Figure 1:
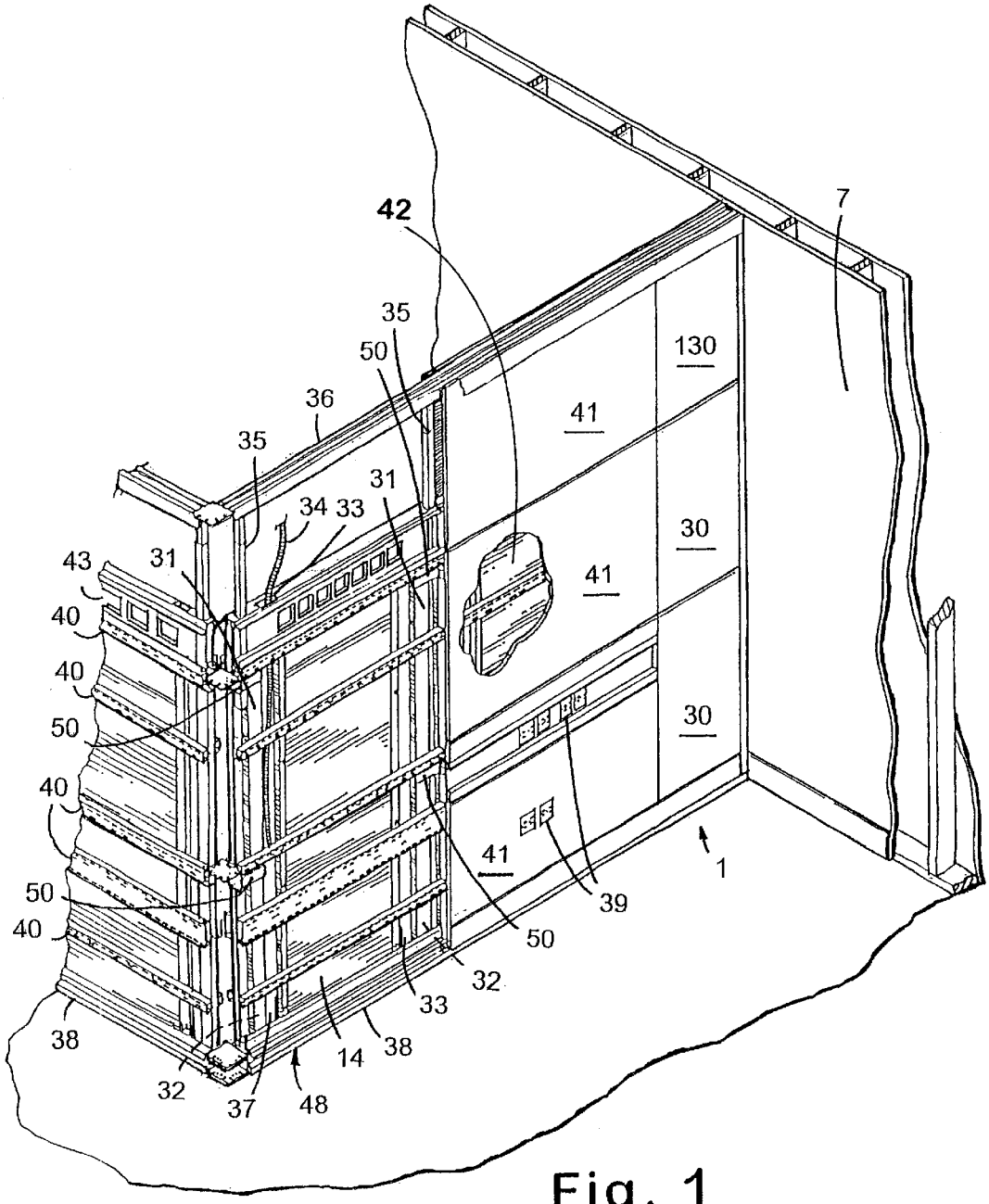
FIG. 1 is a fragmentary, perspective view of a floor-to-ceiling panel system including a variable width panel of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
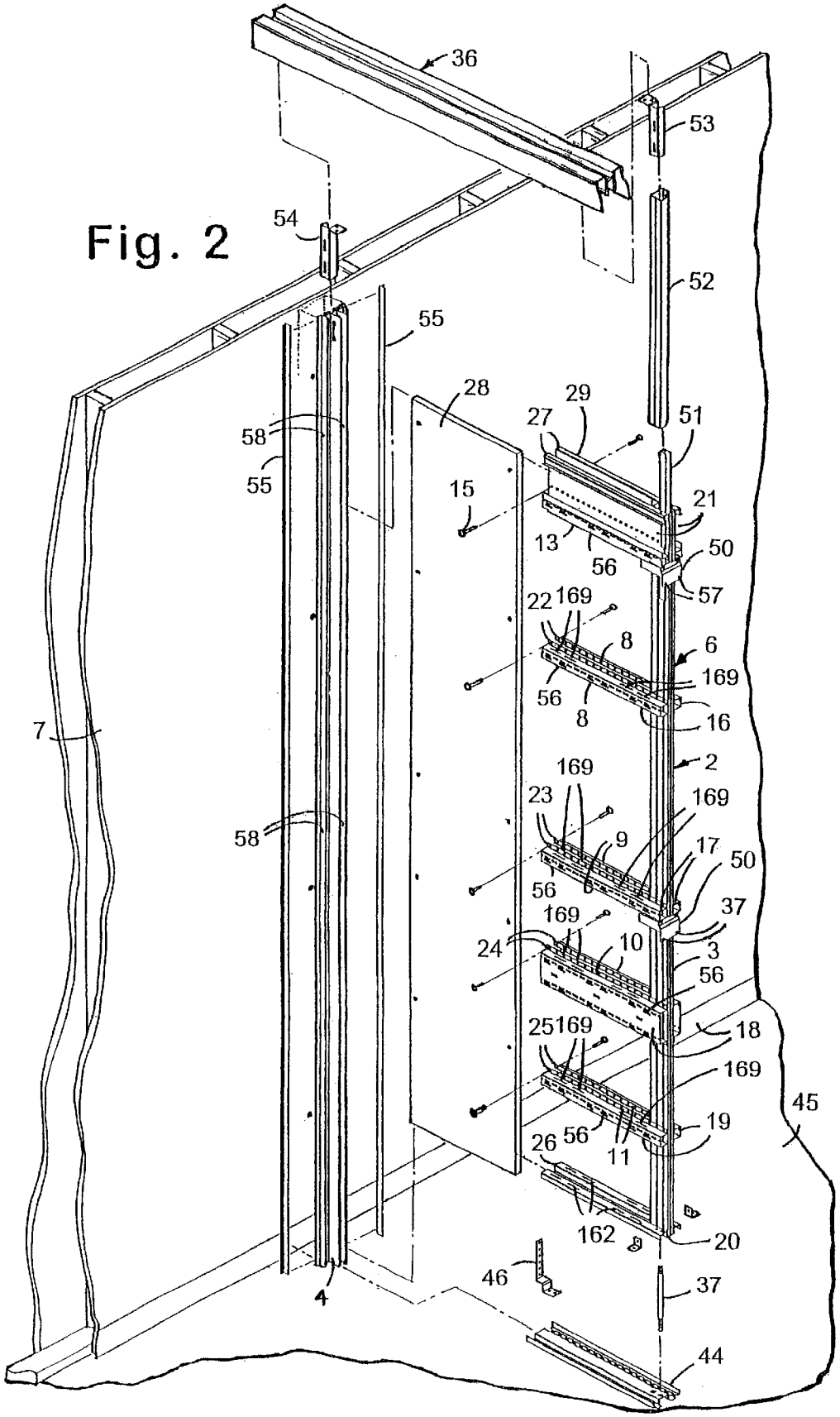
FIG. 2 is a fragmentary, exploded perspective view of the variable width panel frame.
Figure 4:
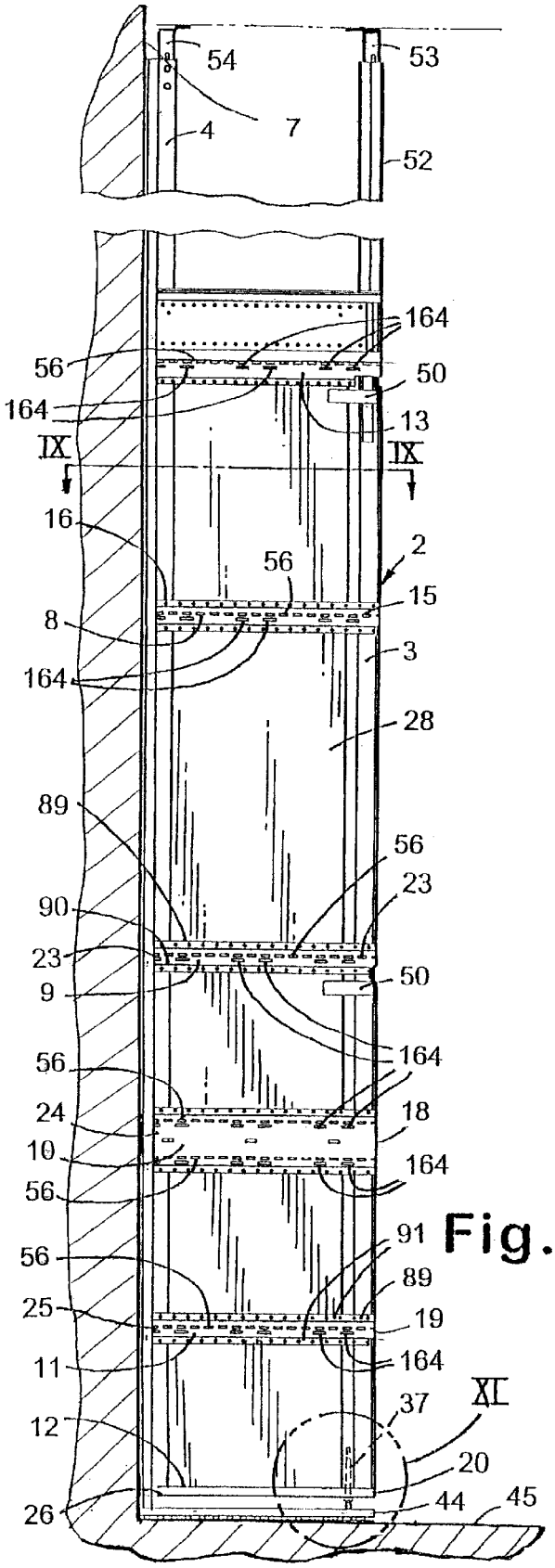
FIG. 4 is a front elevational view of the variable width panel frame.
Figure 3:
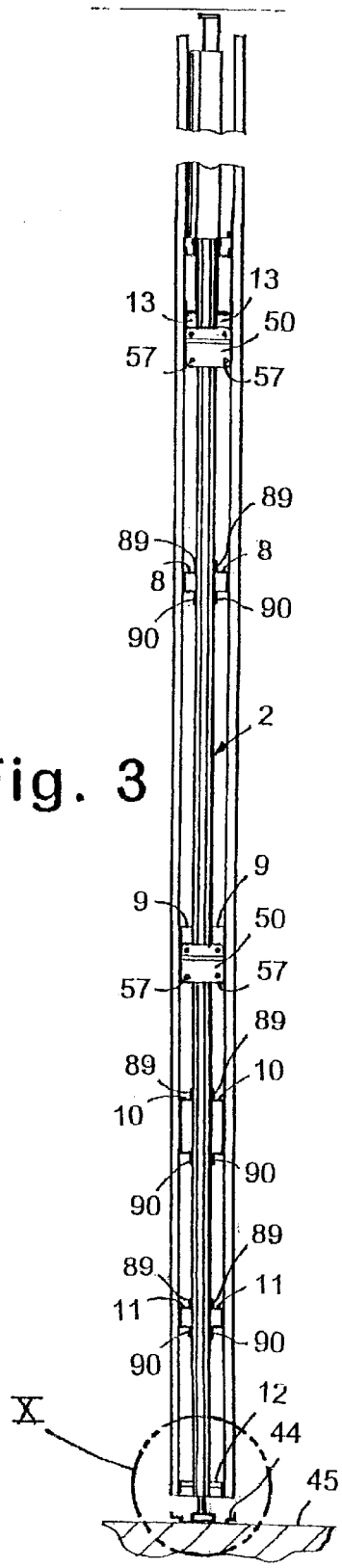
FIG. 3 is a side elevational view of the variable width panel frame.

The reference numeral 1 (FIG. 1) generally designates a variable width panel embodying the present invention, which is designed for dividing office spaces and other similar settings and environments. Variable width panel 1 has a knock-down construction adapted for on-site assembly. A frame 2 (FIG. 2) includes at least two rigid stiles adapted to be disposed in a generally vertical assembled orientation along opposite sides 5 and 6 of the frame 2. In the illustrated example, a first stile 3 is located at the side 6 of the frame 2, and a second stile such as a wall track 4 is adapted to be fastened to an existing architectural wall 7. The variable width frame 2 also includes at least two rigid cross-members, such as horizontal frame members 8, 9, 10, 11, 12, and 13 that are adapted to extend between the stiles in a vertically spaced-apart generally horizontal assembled orientation. The cross-members 8–13 have a predetermined full width with a construction which permits the cross-members 8–13 to be cut to a custom width during the on-site assembly for use in a special width panel 1 that is adapted for connection with the standard width panels 14 (FIG. 1). The variable width frame 2 further includes fasteners 15 for detachably connecting the cross-members 8–13 with the stiles 3 and 4 to define a pocket therebetween. In the illustrated example, the ends 16–21 of cross-members 8–13 are welded to the stile 3 prior to on-site assembly. However, cross-members 8–13 could also be connected to the stile 3 using fasteners 15 during assembly. The variable width panel kit also includes a core panel, such as gypsum sheet 28 shaped to be received within the pockets 29 defined between adjacent cross-members 8–13. The core panel 28 has a predetermined full width "W1" (FIG. 7) with a construction which permits the core panel 28 to be cut to a custom width along line "A" during the on-site assembly for use in the special width panel 1. The kit further includes at least one cover panel 30 (FIG. 8) configured to be detachably mounted on the frame 2, and enclose an associated portion of the same. The cover panel 30 has a predetermined full width with a construction which permits the cover panel to be cut to a custom width during on-site assembly for use in the special width panel 1.

Figure 34:
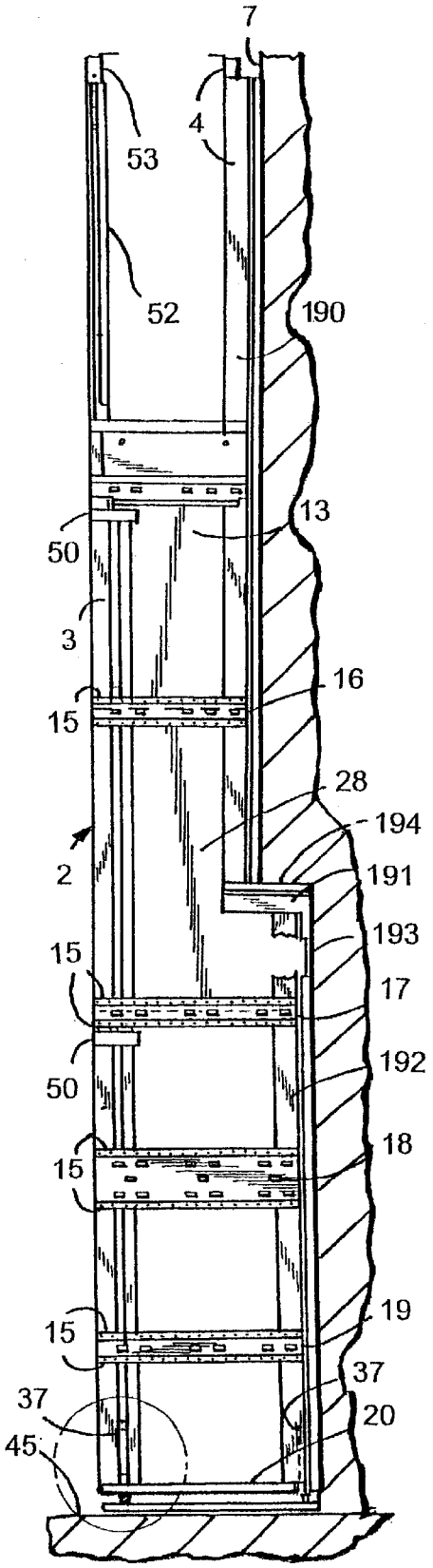
FIG. 34 is a front elevational view of the variable width panel frame installed along an architectural wall having a non-vertical portion.

With reference to FIG. 1, the variable width panel 1 of the present invention is designed to be shipped in a knocked-down condition, and custom fitted between a standard width panel 14 and an existing architectural wall 7, or between a pair of standard width panels 14 (FIG. 23), or at an end-of-run location wherein the wall track 4 forms the end of the partition wall. Furthermore, variable width frame 2 can be fitted along an architectural wall having a stepped, angled, or other irregular surface (FIG. 34). With reference to FIG. 1, the standard width panels 14 include vertical stiles 31 located along each side edge. The stiles 31 have a generally S-shaped cross section forming outwardly-opening vertical raceways 32 and 33 to permit vertical routing of wiring 34 upwardly to the existing ceiling. A pair of adjustable supports 35 connect to a ceiling track 36, and a pair of jack screws 37 adjustably support the panel 14 on a floor track 38. Horizontal cross-members 40 are welded to the stiles 31 to form a standard width frame 48. A solid core panel 42 is located between cross-members 40. Electrical receptacles 39 may be mounted on the horizontal cross-members 40, and cover panels 41 are removably mounted on the panel frames. A pair of brackets 50 are mounted adjacent each side edge of frame 48, and include clearance holes 57 that receive bolts or other fasteners to interconnect adjacent standard width frames 48 in an end-of-run manner at the side edges thereof. An expressway 43 provides for lay-in of horizontal utility lines.

Figure 33:
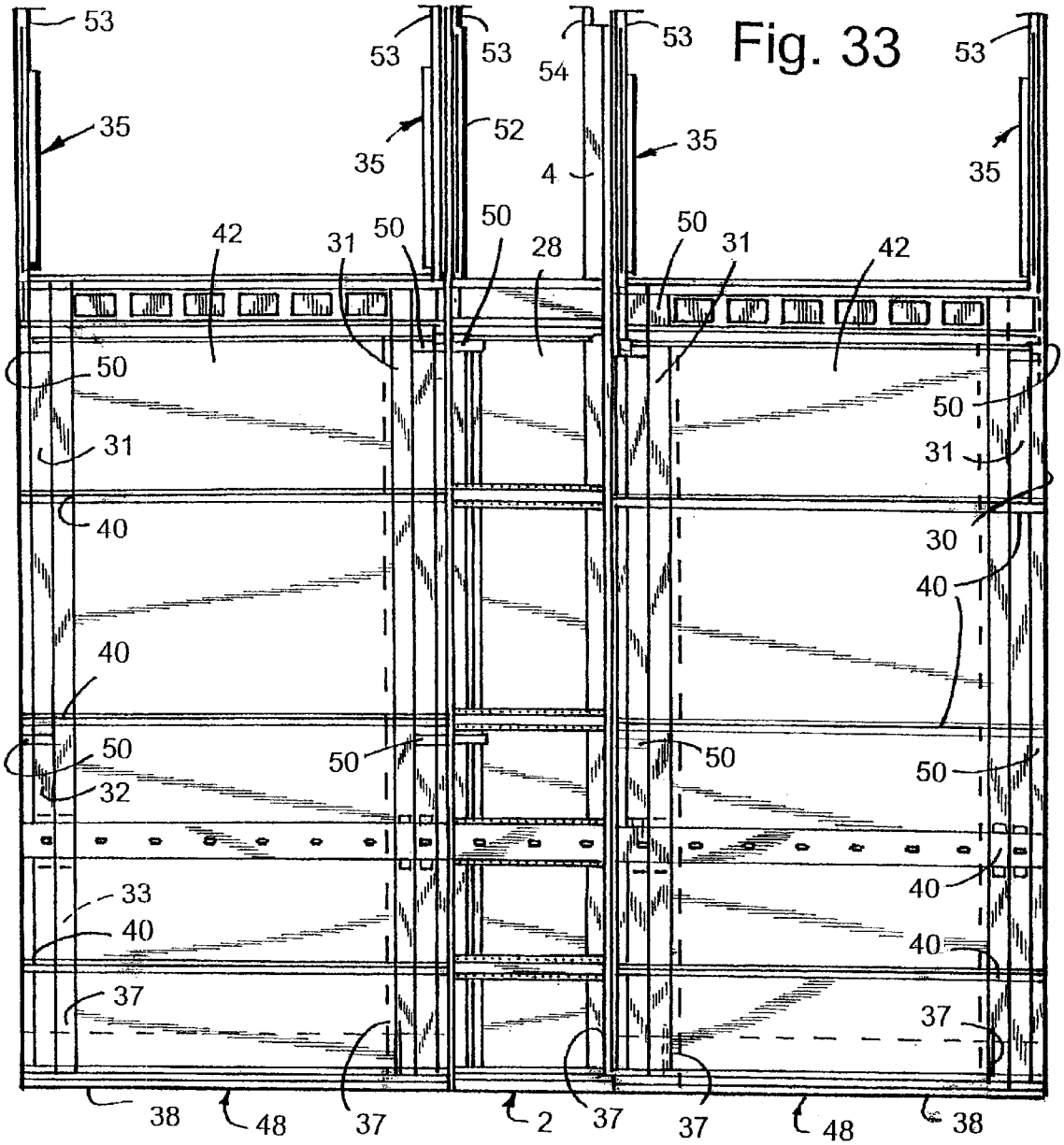
FIG. 33 is a front elevation view of the variable width panel frame connected to a pair of standard width panel frames.

As discussed above, in the illustrated embodiment, horizontal cross-members 8–13 are welded to the stile 3 prior to on-site assembly, and are connected to the wall track 4 during assembly by fasteners 15. A floor track 44 is shaped to support the variable width panel on the existing floor surface 45, and is cut to length during assembly. As discussed in more detail below, a bracket 46 is configured to adjustably interconnect the wall track 4 and the floor track 44. The jack screw 37 adjustably supports the frame 2 on the floor surface 45. A pair of brackets 50 interconnect the variable width panel to the brackets 50 of an adjacent standard width panel 14 by means of standard fasteners which are received in clearance holes 57. Wall track 4 includes clearance holes 58 that can be aligned with the clearance holes 57 of a bracket 50 of an adjacent full width panel frame 48 and fasteners inserted therethrough. Because stile 3 and/or wall track 4 can be secured to an adjacent standard width panel frame 48, variable width frame 2 can be installed at a mid-run location between standard width panels frames 48 (FIG. 33). A C-shaped stanchion 51 is rigidly connected to the frame 3, and extends upwardly therefrom. A structural extension 52 fits over the stanchion 51, and an upper bracket 53 interconnects the structural extension 52 and the ceiling track 36. A second upper bracket 54 interconnects the wall track 4 and the ceiling track 36. As described in more detail below, a pair of trim strips 55 snap into the wall track 4 to cover the edge of the cover panel 30.

During installation, the cross-members 8–13 are cut along the free ends 22–26 thereof. Although the cross-members 8–13 could be connected to the stile 3 using screws or other fasteners during assembly, it is presently preferred that the horizontal members are welded to the vertical stile 3 prior to on-site assembly. This arrangement provides additional rigidity, such that hang-on accessory units, such as storage bins, worksurfaces, and the like can be connected to the horizontal rows of slots 56 in the horizontal cross-members. For the welded configuration illustrated in FIG. 2, the stile with the welded-on cross-members is placed in a band saw, and the free ends 22–26 of the cross-members are cut to the desired length.

Figure 5:
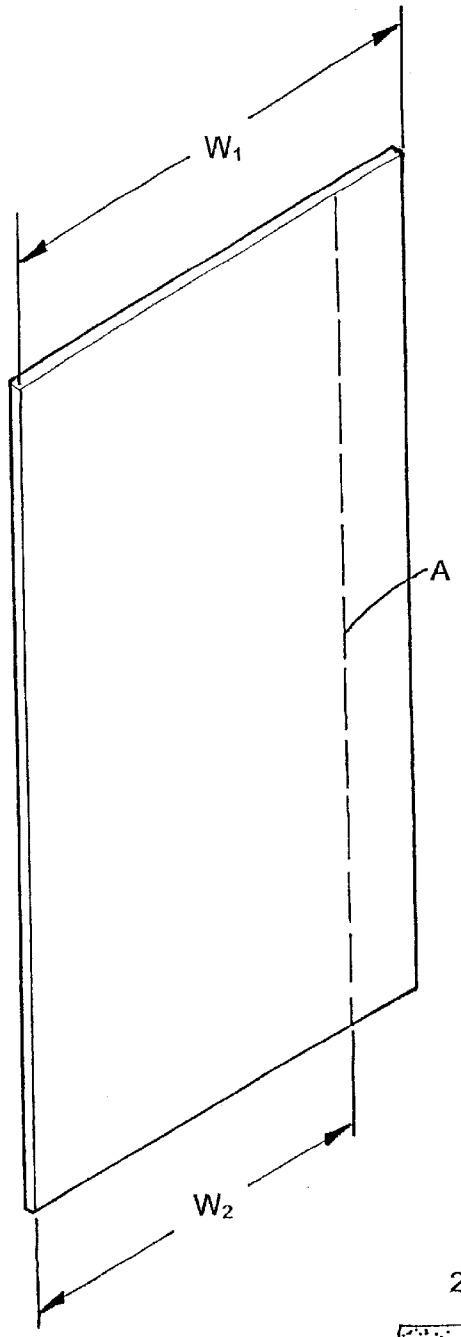
FIG. 5 is a perspective view of the core panel prior to cutting.
Figure 6:
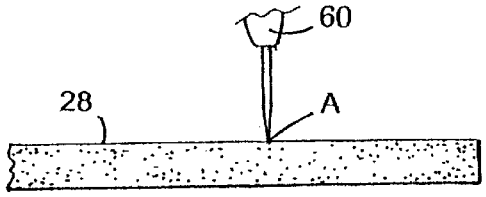
FIG. 6 is a fragmentary, schematic view showing the cover panel being scored.
Figure 7:
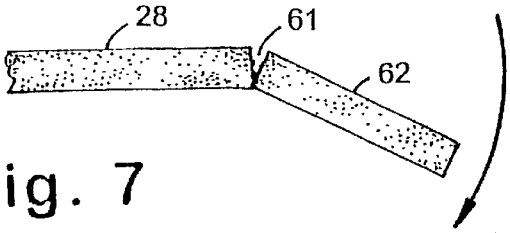
FIG. 7 is a fragmentary, schematic view of the core panel being fractured to the required width.

With reference to FIGS. 5–7, core panel 28 preferably made of a gypsum sheet with a prefabricated width W1. Core panel 28 could be constructed from other materials, such as a metal sheet, fiberglass, or other material providing an acoustic barrier. During assembly of the variable width panel 1, a knife 60 or other cutting instrument is used to score the gypsum sheet 28 along the line A, and the outer portion 62 of the core panel 28 is removed by fracturing panel 28 at 62 (FIG. 7).

Figure 9:
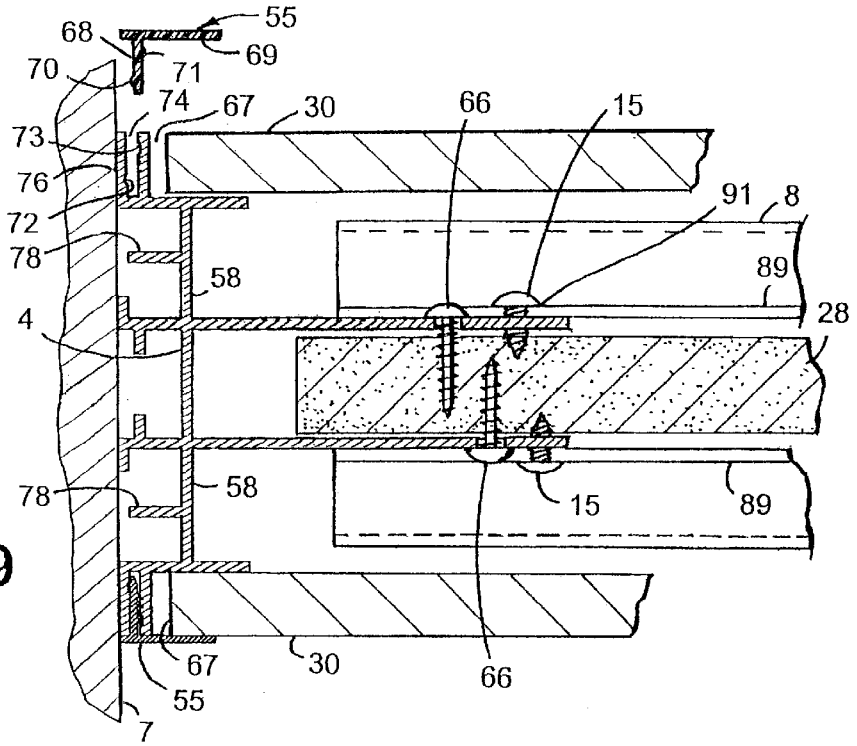
FIG. 9 is a fragmentary view of the wall track taken along the line IX—IX, FIG. 4.

As best in seen in FIG. 9, wall track 4 includes a pair of parallel sidewalls or flanges 65 which receive core panel 28 therebetween. Fasteners 66 may be used to secure the core panel 28 to the wall track 4. As described in more detail below, cover panels 30 and 130 are cut to fit, forming a free edge 67 which is retained to wall track 4 by elongated retainers such as trim strips 55. Retainers 55 may be made of a polymeric material, and have an L-shaped cross section with a first leg 68, and a second or inner leg 69. The inwardly-extending first second leg 68 includes raised lip portions 70 and 71, such that the trim strip 55 is retained in grooves 72 and 73 of the channel 74 formed by flanges 75 and 76 of side face 64 of the wall track 4. The second leg 69 of the retainer 55 extends over in retains the cut edge 67 of the cover panel 30. Because the cut edge 67 may be frayed, or unsightly due to the cutting operation, the second leg 69 provides a finished appearance when assembled. Furthermore, the second leg 69 of the retainer 55 ensures that the cut edge 67 of the panel 30 maintains a flat shape. Wall track 4 is preferably extruded of aluminum, and could be anchored to the existing building wall 7 by a fastener or other suitable means. However, because wall track 4 is secured to ceiling track 36 at an upper end, and to floor track 38 at a lower end, wall track 4 does not need to be secured to the architectural wall for most applications. Accordingly, the variable width frame 2 can be easily disassembled and moved without damaging the existing architectural wall. As discussed above, the variable width panel frame 2 of the present invention can be used at an end-of-run location wherein wall track 4 does not abut an existing architectural wall. In this configuration, a vertical cover (not shown) is supported by flanges 78, and provides a finished appearance. Cross-members 8–13 include upper and lower flanges 89, 90 with clearance holes 91 that receive fasteners 15 to secure the horizontal cross-members 8–13 to wall track 4.

Figure 10:
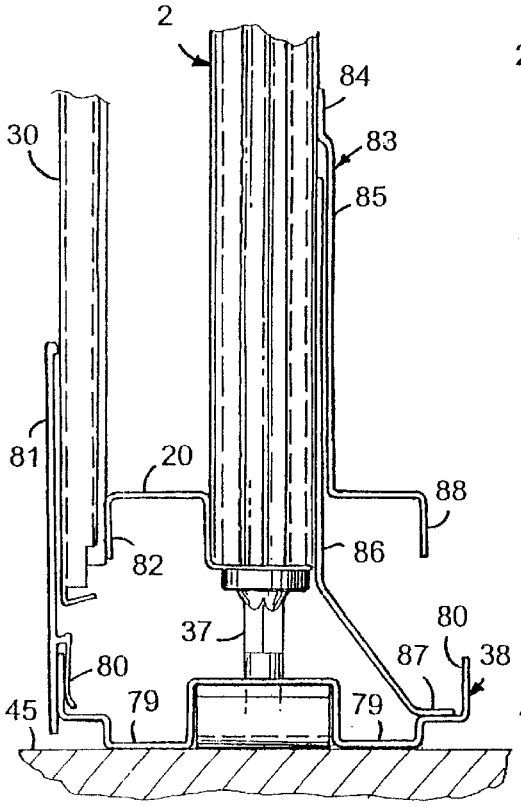
FIG. 10 is a side elevational view of the lower portion of the panel frame of FIG. 3.
Figure 11:
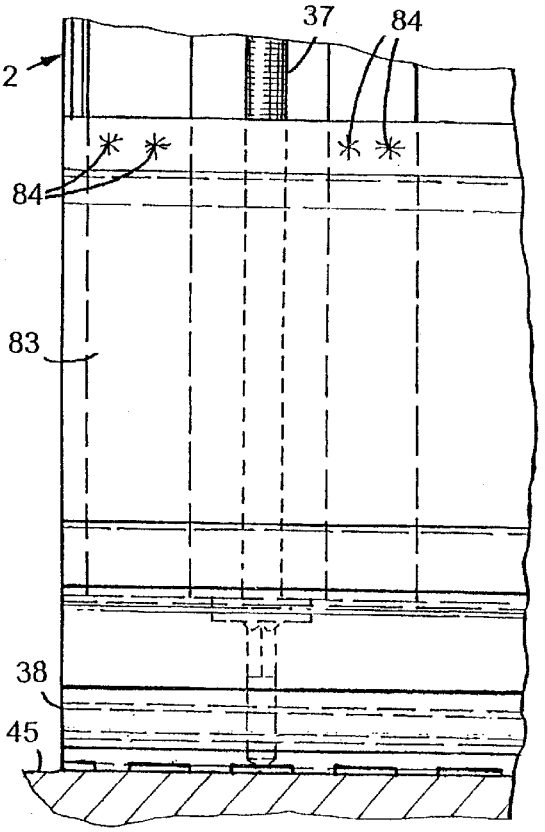
FIG. 11 is a fragmentary view of the lower portion of the panel frame of FIG. 4.

With reference to FIGS. 10 and 11, floor track 38 includes a pair of web portions 79 which abut the floor surface 45. An upwardly-extending outer flange removably supports a base trim piece 81. Lower cross-member 20 includes a downwardly-extending outer flange 82, such that the cover panel is supported between flange 80 of floor track 38, and flange 82 of cross-member 20. A thin sheet metal flange member 83 may be welded to one side of frame 2 at 84. The flange member 83 includes an offset portion 85 which extends downwardly over upwardly-extending acoustic barrier 86. Acoustic barrier 86 is also made of a thin sheet metal material, and is welded to the floor track 38 at the lower flange 87. Flange member 83 includes a downwardly-extending outer flange member 88 that supports a cover panel 30 in the same manner as flange 82 of cross-member 20.

Figure 12:
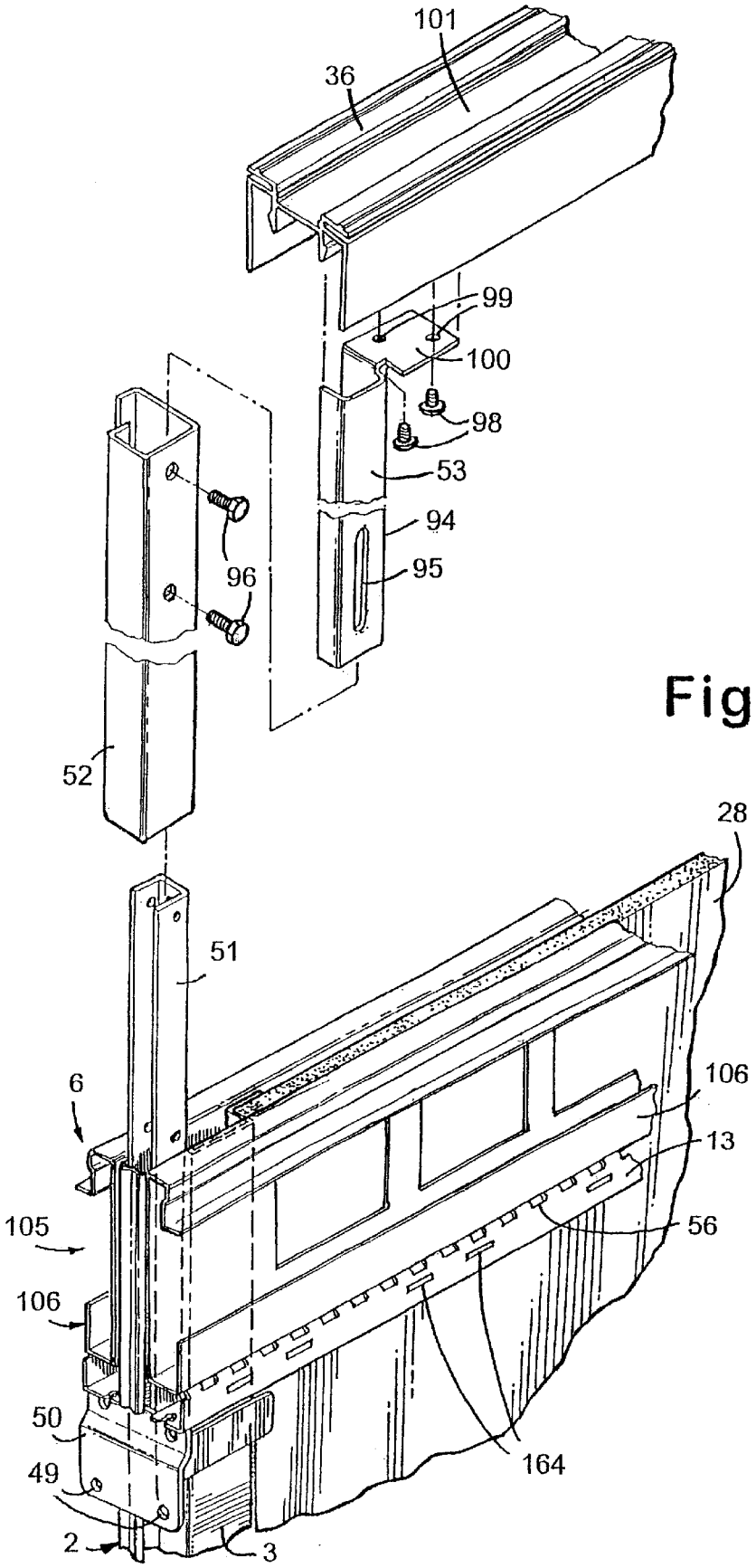
FIG. 12 is a fragmentary, exploded perspective view showing the upper portion of the panel frame and ceiling track.

With reference to FIG. 12, stile 51 has a C-shaped cross section and is rigidly fixed to the frame 2 and extends upwardly along the side edge 6 thereof. Structural extension 52 has a G-shaped cross section and fits over the stanchion 51. Upper bracket 53 has a lower portion having a C-shaped cross section which is telescopically received within the structural extension 52. Self-tapping fasteners or other screws 96 are received in holes 97 of structural extension 52 and also through the slot 95 in the upper bracket 53 to adjustably interconnect the frame 2 and the ceiling track 36. Fasteners 98 extend through clearance holes 99 in upper flange portion 100 of bracket 53, and into the center web portion 101 of ceiling track 36.

Expressway 105 includes a pair of outwardly-opening C-shaped channels 106. As described above, bracket 50 abuts an adjacent bracket 50 of a standard width panel frame 48 when in the assembled condition, and conventional fasteners are received through the clearance holes 49 to connect the variable width panel frame 2 to an adjacent standard width panel frame 48.

With reference to FIG. 13, channels 106, 107 each include an outwardly extending flange 107, and an upwardly-extending lower flange 108 to retain an expressway cover 109. The lower flange 108 forms an upwardly-opening U-shaped lower channel 110 to receive lay-in wiring or other utilities.

Figure 16:
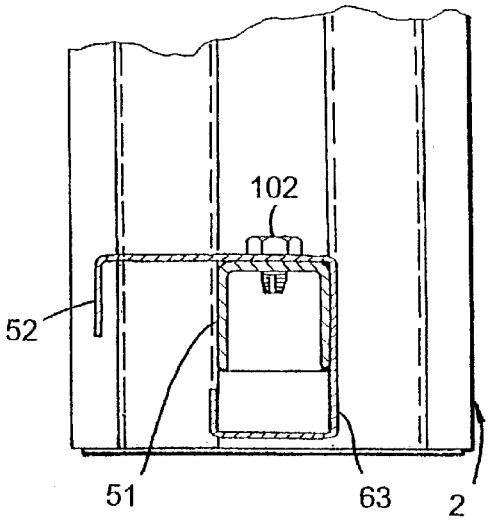
FIG. 16 is a cross-sectional view of the stanchion and structural extension taken along XVI—XVI, FIG. 13.
Figure 15:
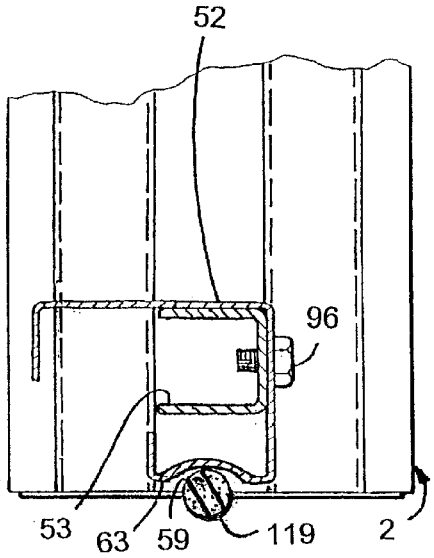
FIG. 15 is a cross-sectional view of the structural extension and bracket taken along the line XV—XV, FIG. 13.

With reference to FIG. 15, bracket 53 is telescopically received within the G-shaped structural extension 52 to provide vertical height adjustment to account for differences in the floor-to-ceiling distance. If required, structural extension 52 can be cut to a shorter length to provide additional adjustability. When frame 2 is connected to an adjacent standard width frame 48, sidewall 63 of structural extension 52 is parallel to, and spaced-apart from the sidewall 63 of the adjacent structural extension 52 of the standard width panel frame 48. Structural extension 52 may include a groove or indention 59 that receives a resilient seal 119 to provide a sound barrier between the variable width frame 2 and the adjacent standard width frame 48. As best seen in FIG. 16, structural extension 52 is secured to the stanchion 51 by fasteners 102.

Figure 17:
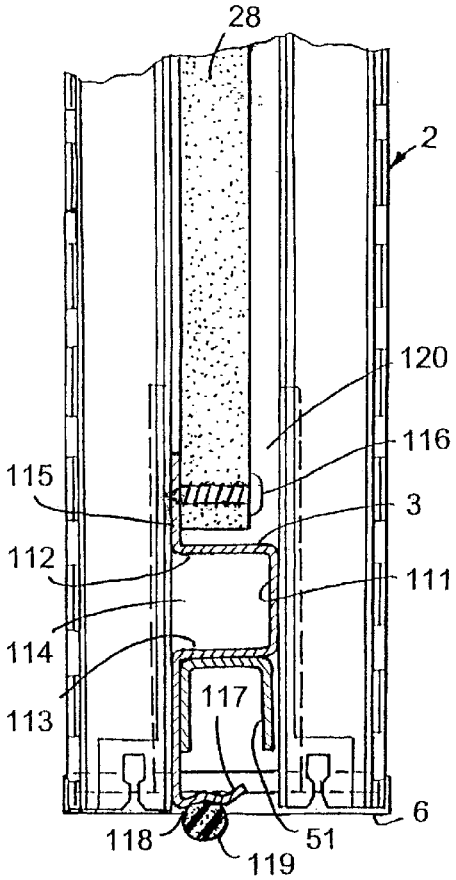
FIG. 17 is a cross-sectional view of the panel frame taken along the line XVII—XVII, FIG. 13.

With reference to FIG. 17, stile 3 includes a web 111, with transversely extending walls 112 and 113 that form an outwardly-opening vertical channel 114 for vertical routing of wiring or other utilities along the side edge 6 of the variable width panel 1. A screw or other fastener 116 secures the core panel 8 to an inwardly-projecting end flange 115 of stile 3 during assembly. Flange 115 forms a portion of pocket 120 for mounted core panel 28. However, pocket 120 could have a variety of configurations suitable for mounting core panel 28. The side flange 117 of the vertical stile 3 includes a vertically extending groove or indention 118 which receives a compressible, cylindrical sealer strip 119 when the variable width panel frame 2 is connected to an adjacent standard width panel frame 48.

Figure 18:
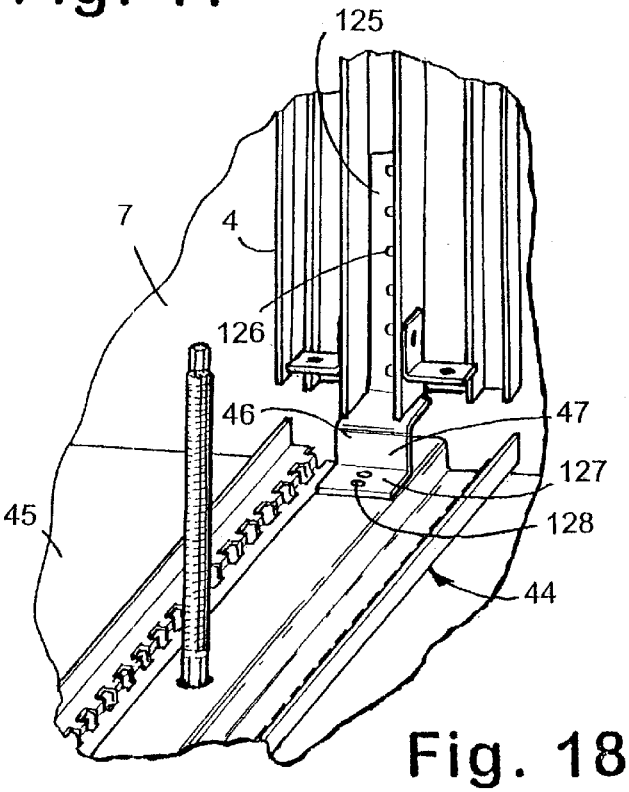
FIG. 18 is a perspective view showing a bracket interconnecting the floor track and the wall track.

With reference to FIG. 18, bracket 47 includes an upwardly-extending strap portion 125 which is received between the side flanges 65 of the wall track 4, and a fastener (not shown) is received through the clearance holes 126 of strap 125 to secure the bracket 47 to the wall track 4. Lower flange 127 of bracket 47 includes clearance holes 128 which receive fasteners to secure the bracket 47 to the floor track 44, thereby adjustably interconnecting the floor track 44 and the wall track 4.

Figure 20:
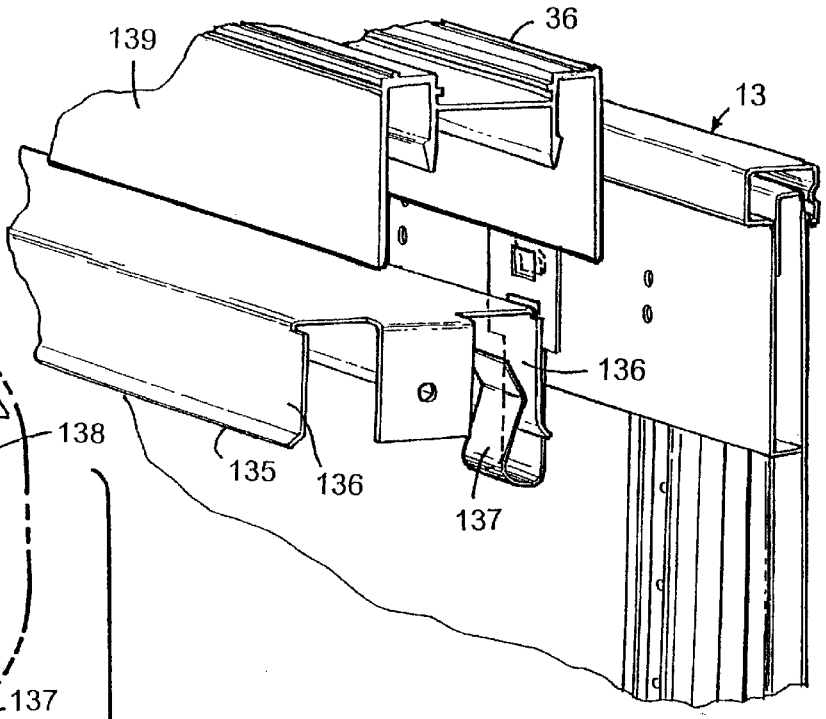
FIG. 20 is a fragmentary, perspective view of an upper cover panel.
Figure 19:
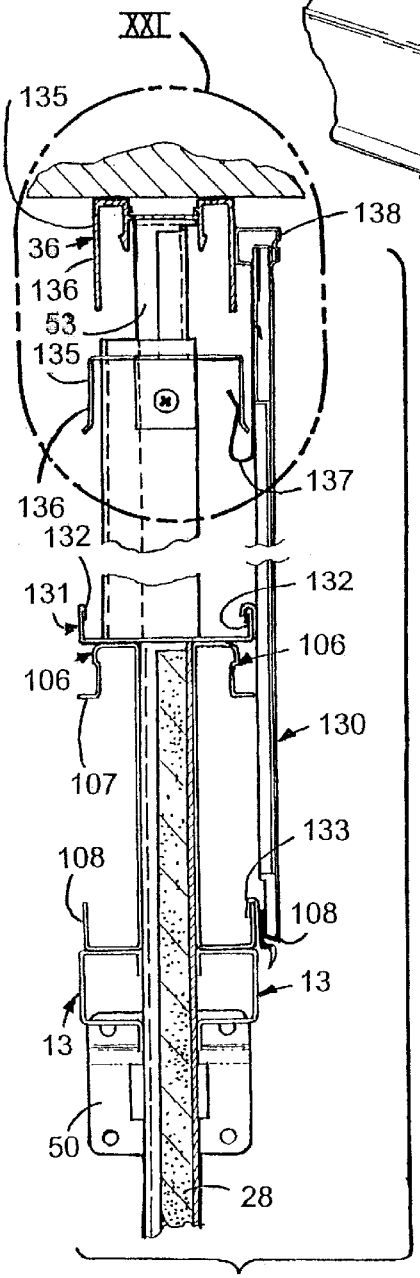
FIG. 19 is a fragmentary, side elevational view of an upper portion of the panel showing an upper cover panel.
Figure 21:
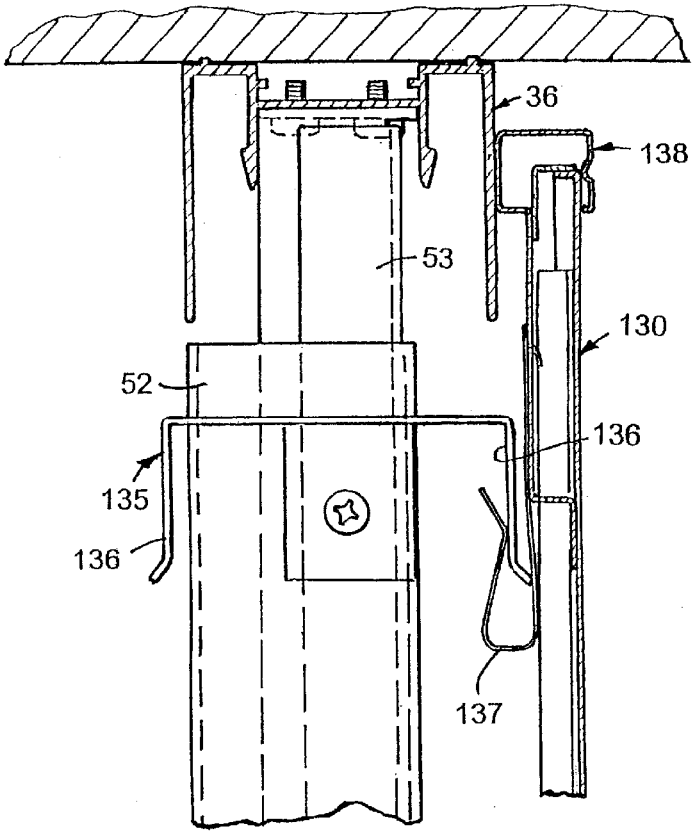
FIG. 21 is a fragmentary, side elevational view of the ceiling track and upper cover panel of FIG. 19.

With reference to FIGS. 19–21, an upper cover panel 130 is used to close off the area between the expressway 105 and the ceiling track 36. An upwardly-opening, U-shaped channel 131 may be secured to the C-shaped channels 106. Upper cover panel 130 includes a downwardly-opening flange 133 extending along the lower edge thereof. Cover panel 130 may have sufficient height to extend downwardly, thereby covering expressway 105, with the flange 133 being supported on the flange 108 of channel 106. Alternatively, if desired for particular application, cover panel 130 may be supported along the lower edge by the flange 132 of the channel 131, with a removable expressway cover 109 (FIG. 13) closing off the expressway. A cover support member 135 is connected to the upper bracket 53 and/or the structural extension 52, and includes a pair of downwardly-extending side flanges 136. An upwardly-opening clip 137 retains the upper cover 130 to the flange 136, with the upper tubular portion 138 of the cover panel 130 abutting the side wall 139 of the ceiling track 36.

Figure 23:
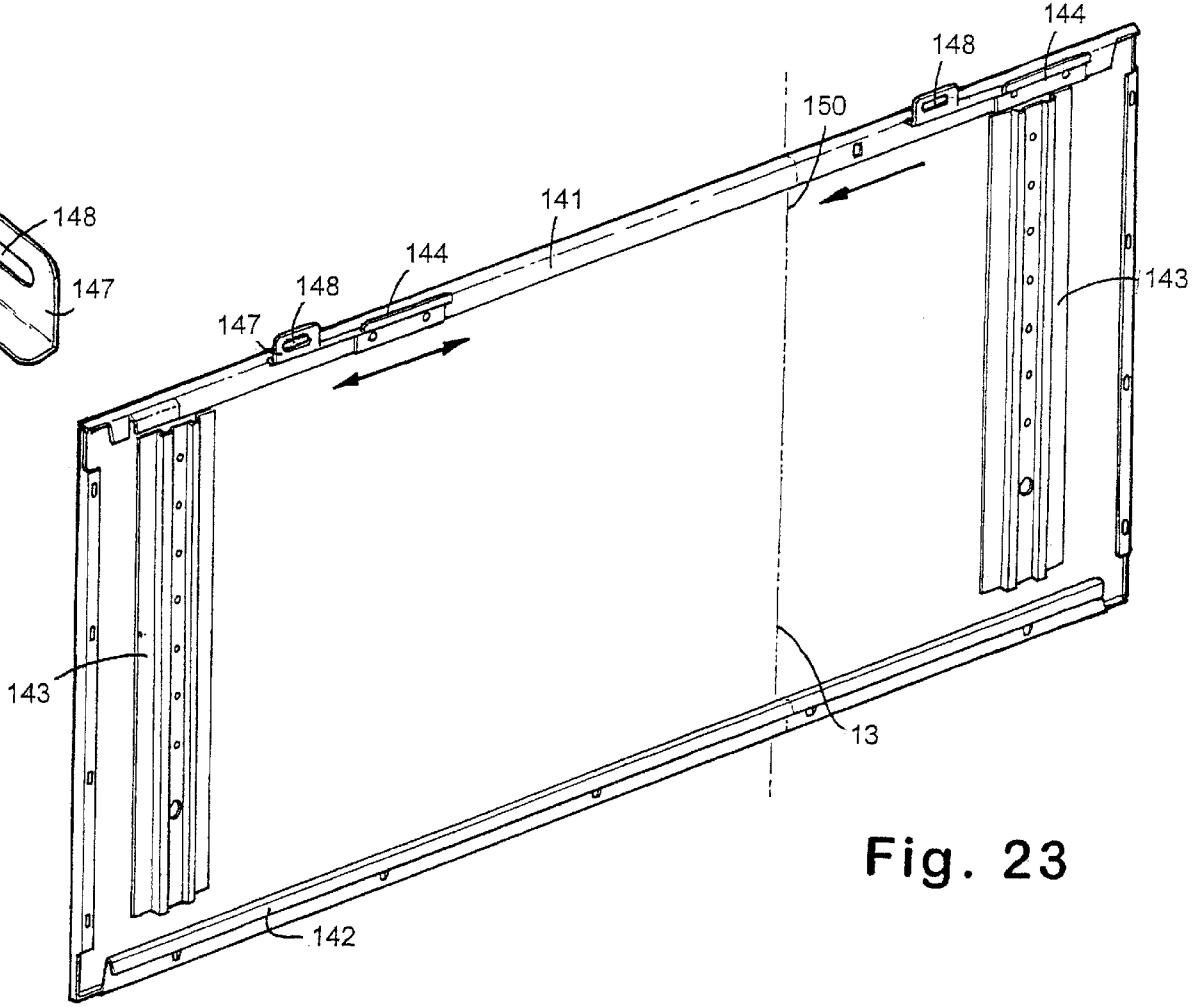
FIG. 23 is a perspective view of an upper cover panel.
Figure 22:
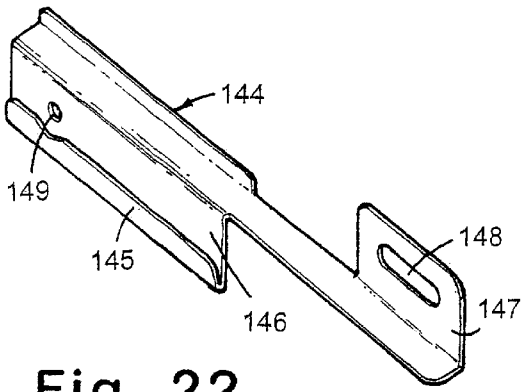
FIG. 22 is a perspective view of a connector for the cover panel of FIG. 23.

With reference to FIGS. 22 and 23, another type of upper cover panel 140 includes a downwardly-extending upper flange 141 and an upwardly-extending lower flange 142. A pair of braces 143 may be fastened to the panel 140 for rigidity. A pair of connectors 144 include a web 146, with an upwardly-extending flange 145 along the lower edge thereof. As described in more detail below, an opening or slot 148 in tab 147 receives a fastener to secure the connector 144 to a side wall 139 of the ceiling track 36. A clearance hole 149 in web 146 receives a rivet or other fastener to secure the connector 144 to the flange 141 of the cover panel 140. During installation, the cover panel 140 may be cut along the line "B" as required for particular application. Accordingly, the connector 144 is moved inwardly from the position illustrated in FIG. 23 and a fastener is inserted through the clearance hole 149 to secure the connector 144 adjacent the cut edge 150 created when the panel 140 is cut along the line B. When cover panel 140 is installed, trim strips 55 retain and cover cut edge 150 to provide a finished appearance.

Figure 24:
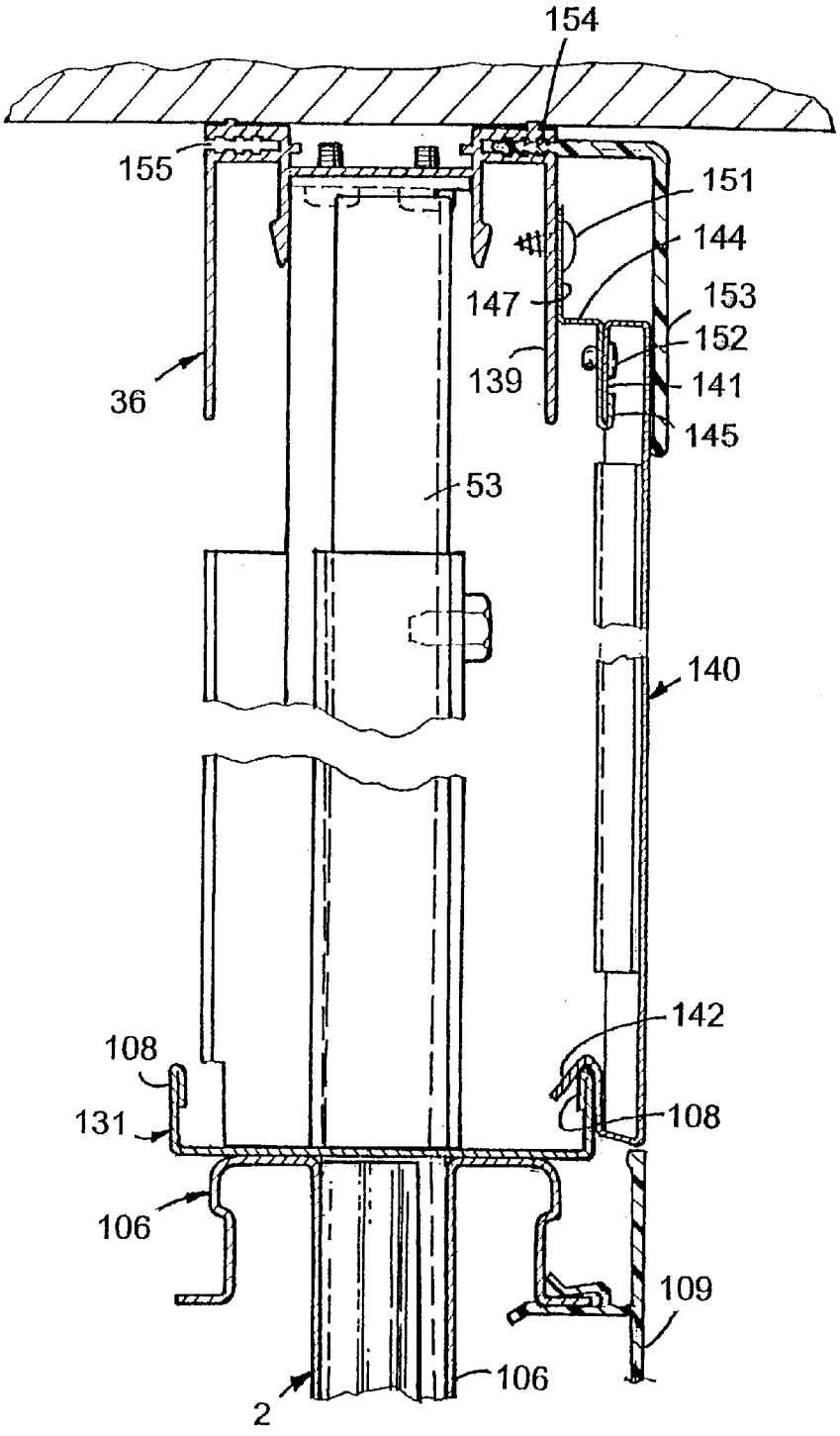
FIG. 24 is a fragmentary, side elevational view of the upper portion of the variable width panel showing the cover panel of FIG. 23.

With reference to FIG. 24, cover panel 140 has a sheet metal skin which forms downwardly-opening flange 142 which is received on the flange 108 of the channel 131 to support the lower edge of the upper cover panel 140. A rivet 152 or other fastener secures the connector 144 to the upper flange 141 of cover panel 140, and self-tapping screws or other fasteners 151 are received in holes 148 of connector 144 to secure the cover panel 140 to the side wall 139 of ceiling track 36. In the embodiment of FIG. 24, a polymer trim strip 53 includes a barbed end portion 154 which is received into a notched channel 155 which extends along the ceiling track 36 to thereby removably connect the trim piece 153 thereto.

Figure 8:
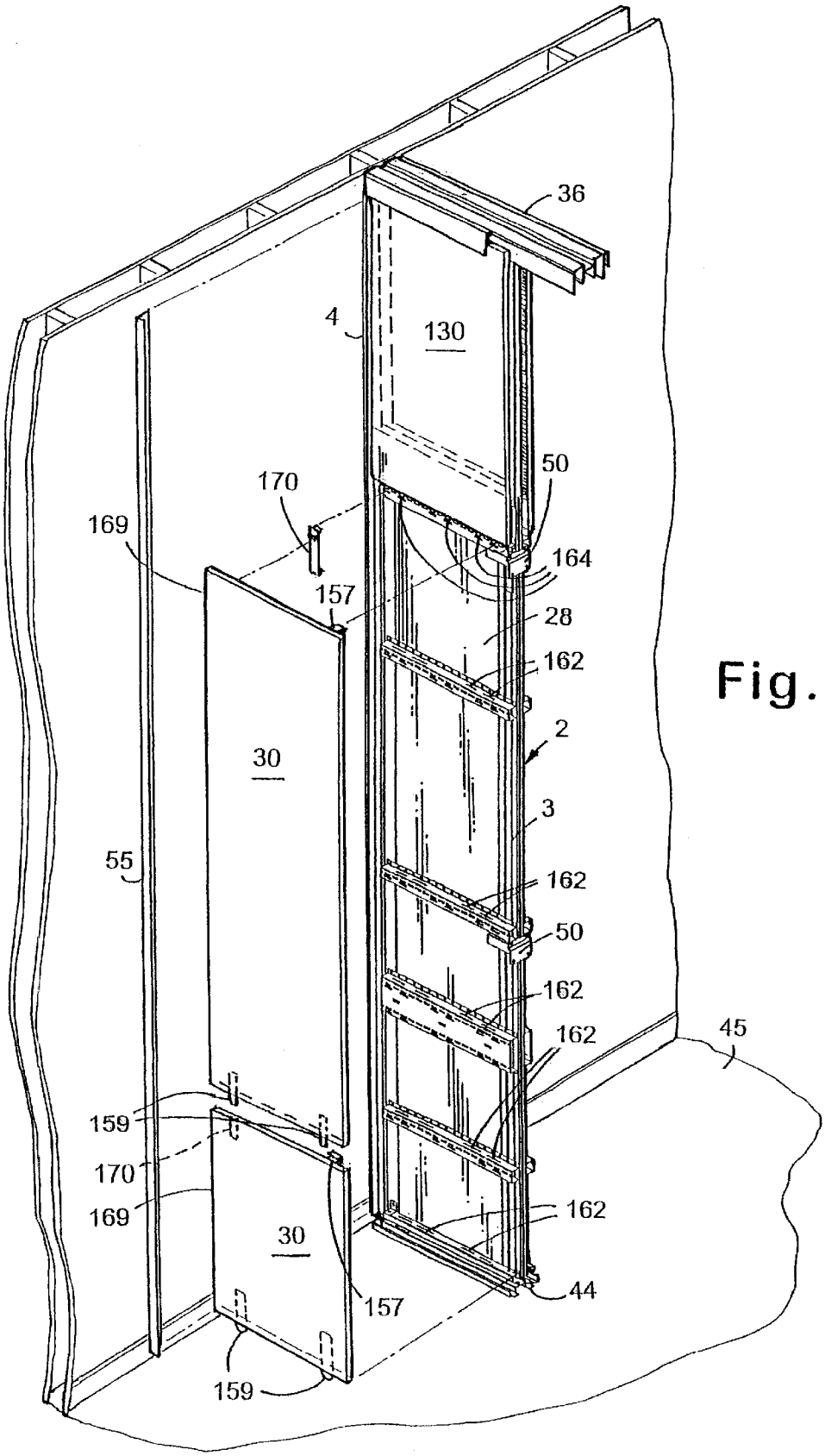
FIG. 8 is a fragmentary, perspective view showing the installation of the lower cover panels.
Figure 25:
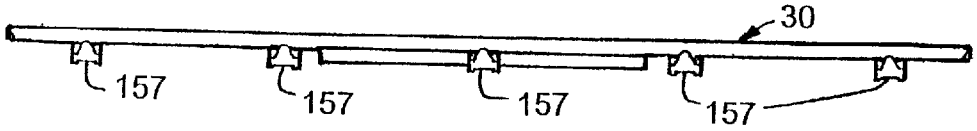
FIG. 25 is a top plan view of a lower cover panel.
Figure 26:
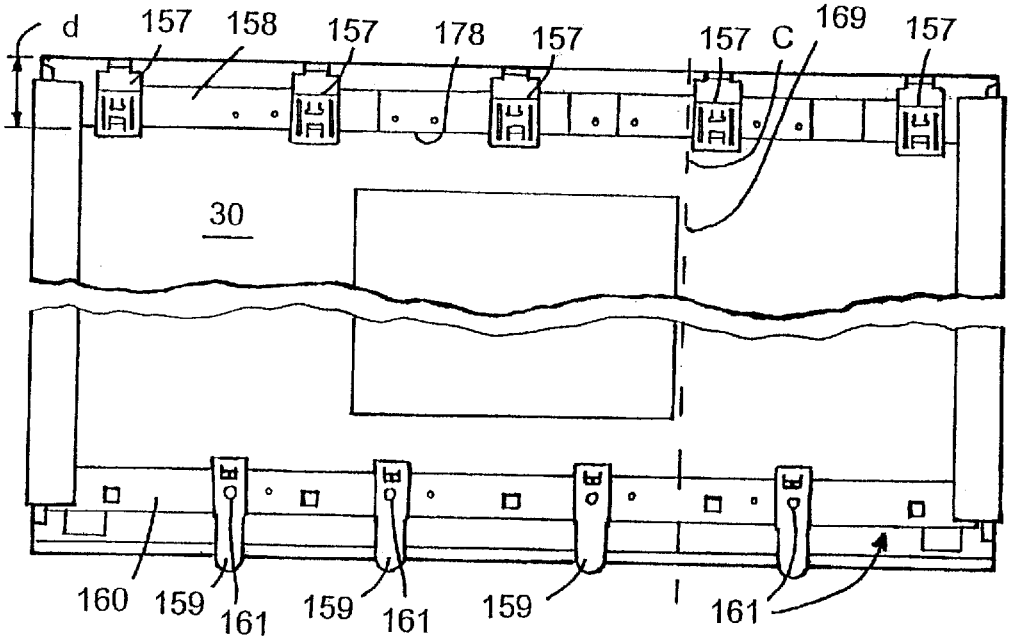
FIG. 26 is a fragmentary, front elevational view of a lower cover panel.
Figure 27:
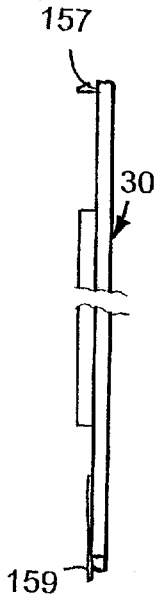
FIG. 27 is a fragmentary, side elevational view of a lower cover panel.

With reference to FIGS. 25–27, the lower cover panels 30 may be either a wood panel, a tackable acoustic panel, or non-tackable acoustic panel. The lower cover panels 30 cover the lower portion of the panel 1 below the expressway 105. Cover panels 130 include a plurality of clips 157 that are removably received on the downwardly-extending upper flange 158 of the lower cover panel 30. A plurality of fingers 159 are pivotally mounted on the lower flange 160 at pivot 161. As best seen in FIG. 8, fingers 159 comprise flat sheet metal extensions which are received in slots or openings 162 along the upper surfaces of the horizontal frame members 8–12. Clips 157 are received in openings 164 (see also FIG. 14), and retain the top edge of each lower cover panel 30 to the adjustable width frame 2. Fingers 159 can be pivoted if required to provide access to the horizontal row of slots 56 in the cross-members as required to support hang-on accessory units and the like.

Figure 28:
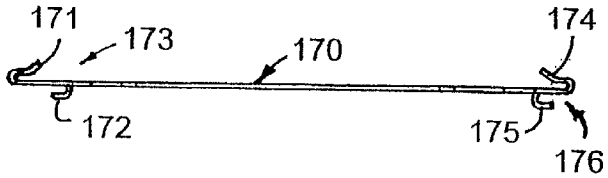
FIG. 28 is a top elevational view of a hanger used with the lower cover panel of FIG. 26 after the lower cover panel is cut to length.
Figure 29:
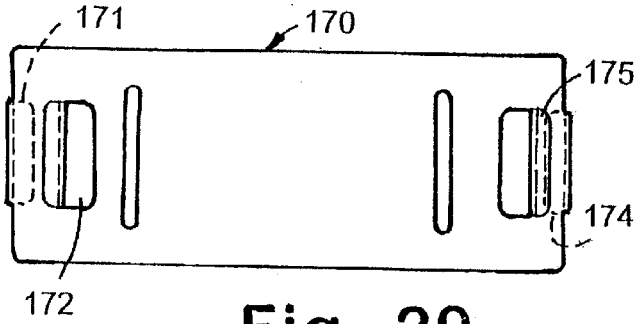
FIG. 29 is a front elevational view of the hanger.
Figure 30:
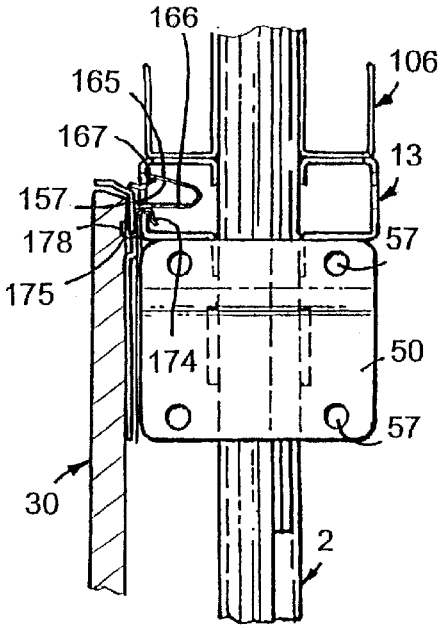
FIG. 30 is a fragmentary, side elevational view showing the mounting of the lower cover panel.
Figure 31:
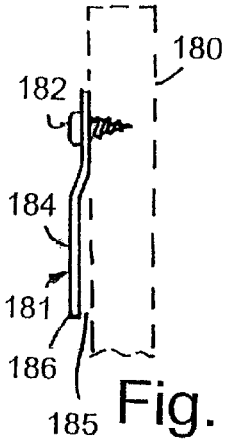
FIG. 31 is a side elevational view of an adaptor used to support a wood lower panel.
Figure 32:
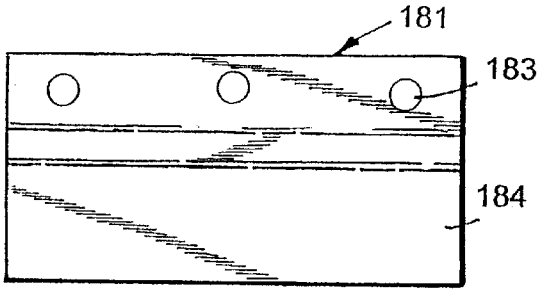
FIG. 32 is a front elevational view of the adaptor of FIG. 31

During assembly, lower cover panel 30 may be cut along a line "C" (FIG. 26), such that an insufficient number of clips 157 are available to support the upper edge 177 of cover panel 30 on the frame 2. Accordingly, a hanger 170 may be used to support the cover panel 30 adjacent cut edge 169. The hanger 170 (FIG. 28) includes a pair of opposed hooks 171 and 172 at a first end 173, and another pair of opposed hooks 174 and 175 at a second end 176. With reference to FIG. 26, the distance "d" between the upper edge 177 of cover panel 30 and the lower edge 178 of the flange 158 varies depending on whether the cover panel 30 is a tackable acoustic panel or a non-tackable acoustic panel. To support a tackable acoustic panel, the hook 172 is placed on the lower edge 178 of flange 158, and hook 171 is inserted into a slot or opening 164 in horizontal frame member 13 (FIG. 30). However, if a non-tackable panel 30 is used, the hook 175 is inserted onto the edge 178 of flange 158, and hook 174 is inserted into opening 164. Accordingly, a single hanger 170 can accommodate differences in spacing "d" for mounting either acoustic or non-acoustic tackable panels. If a wood lower panel 180 is being used, an adapter 181 (FIGS. 31–32) may be fastened to the panel 180 adjacent the upper edge thereof by fasteners 182 which are received in clearance holes 183. Adapter 181 includes an offset flange 184 forming an opening 185 along lower edge 186. When installed, hook 172 or 175 of hanger 170 engages edge 186, and hook 171 or 174 is inserted into opening 174 to support wood panel 180.

As best seen in FIG. 30, clips 157 include an upper leg 165 and a lower leg 166 forming a generally V-shape. Upon insertion of clip 157 into opening 164 of cross-member 13, legs 165 and 166 flex inwardly, and then spring outwardly to the position illustrated in FIG. 30. In the installed position, the end portion 167 of upper leg 165 abuts the inner surface of the cross-member 13, thereby retaining the upper edge of the cover panel 30 to the frame 2.

As discussed above, during assembly of the variable width panel 1, the cross-members 8–13, and the floor track 24 are cut to the required length, the core panel 28 and the upper cover panel 130 or 140, as well as the lower cover panel 30 are also cut to the desired width. Floor track 38 is secured to the existing floor, and ceiling track 36 is fastened to the existing ceiling. If required, core panel 28 and the cover panels 130 or 140 and 30 are the contour of an existing architectural wall, and wall track 4 and trim strips 55 are cut to fit each horizontal or other angled portion of the wall (see also FIG. 34). Furthermore, cross-members 8–13 may be cut to different lengths as required to follow the contour of the architectural wall. Core panel 28 is placed in the pocket formed by the stiles, and secured to the stile 3 using screws or other fasteners. Extension 52 and bracket 53 are then placed on the stanchion 51, and the free ends 22–27 of the cross-members 8–13 are placed around the side walls 65 of the wall track 4. Frame 2 is positioned above the floor track 44 and jack screws 37, and structural extension 52 and brackets 53 and 54 are positioned above frame 2. After the frame 2 is set at the desired height using jack screws 37, the bracket 46 is secured to the wall track 4 and fasteners 15 are used to secure the cross-members 8–13 to the side walls 65 of the wall track 4 with the wall track 4 abutting the architectural wall. Brackets 53 and 54 are then secured to the ceiling track 36, and bracket 53 is also secured to the extension 52. Because wall track 4 is secured to the ceiling track 36 at an upper end, and secured to the floor track at a lower end, wall track 4 does not need to be secured to the architectural wall in most circumstances. Upper cover panels 130 or 140, and lower cover panels 30 are cut to the proper width, and a hanger 170 is used to support the lower cover panel 30 if required. After the cover panels are installed to the frame 2, trim strips 55 are snapped into the wall track 4 to provide a finished appearance.

As discussed above, if the adjustable width frame 2 is being installed between a pair of standard width panels frames 48 (FIG. 33), wall track 4 is secured to the brackets 50 of one of the standard width frames 48 by inserting bolts or other fasteners through clearance holes 58. Brackets 50 of stile 3 are then secured to the brackets 50 of the standard width panels frame 48 using fasteners. This construction permits the variable width panel frame 2 to be installed between the adjacent standard width panel frames 48 in a non-progressive manner wherein each of the adjacent standard width panel frames 48 remain in the installed position. Furthermore, if the variable width frame 2 is being used at an end-of-run location, a cover is placed over wall track 4 to provide a finished appearance.

With reference to FIG. 34, the adjustable width frame 2 may be installed along an architectural wall 7 having an angled, stepped-in, or other irregular surface. The wall track 4 is cut into sections 190, 191 and 192 as required to fit the irregular contour of the architectural wall 7. Horizontal or angled portions 191 can be utilized to provide a finished appearance, despite the irregularity in the architectural wall 7. The cross-members 8–13, are each cut to a length corresponding to the contour of the architectural wall, and core panel 28 is similarly cut, forming a cut edge 193 having a contour corresponding to the irregular wall surface 7. In this manner, the variable width panel frame 2 permits a finished appearance, even if the architectural wall 7 that includes portions 194 that are angled relative to vertical. Furthermore, the adjustable width frame 2 can be easily fitted to two walls that are not plumb.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A reconfigurable office partition having a plurality of prefabricated standard width panels interconnected to define a partition wall; said partition including a variable width panel comprising:

a frame having a knock-down construction adapted for on-site assembly, including:

a first rigid stile adapted to be disposed in a generally vertical assembled orientation along a first side of said frame and defining a centerline;

at least two rigid cross-members having first ends thereof rigidly attached to said stile; said cross-members being disposed in a vertically spaced-apart relationship, and extending in a generally horizontal assembled orientation; at least one of said cross-members positioned in a horizontally offset position relative to said centerline; said cross-members having a predetermined full width with a construction which permits said cross-members to be cut to a custom width at a second end thereof during said on-site assembly for use in a special width panel that is adapted for connection with the standard width panels; and a second stile adapted to be disposed in a generally vertical assembled orientation along a second side of said frame opposite said first side; said second stile being shaped for detachable connection with second ends of said cross-members;

fasteners for detachably connecting said second ends of said cross-members with said second stile to define a pocket therebetween;

a core panel shaped to be received in said pocket, and having a predetermined full width with a construction which permits said core panel to be cut to a custom width during said on-site assembly for use in said special width panel;

fasteners for mounting said core panel in said frame; and at least one cover panel configured to be detachably mounted on said frame, and enclose an associated portion of the same; said cover panel having a predetermined full width with a construction which permits said cover panel to be cut to a custom width during said on-site assembly for use in said special width panel.

2. A reconfigurable office partition as set forth in claim 1, wherein:

at least one of said stiles includes an inwardly projecting mounting flange defining at least a portion of said pocket, said flange being cantilevered to form a free edge.

3. A reconfigurable office partition as set forth in claim 2, wherein:

said cross-members include mounting flanges defining at least a portion of said pocket.

4. A reconfigurable office partition as set forth in claim 3, wherein:

said core panel comprises a sheet of gypsum board.

5. A reconfigurable office partition as set forth in claim 3, wherein:

said core panel comprises sheet metal.

6. A reconfigurable office partition as set forth in claim 4, wherein:

said cross-members comprise metal channels with slots for removably mounting said cover panel thereon.

7. A reconfigurable office partition as set forth in claim 6, wherein:

at least one of said stiles includes a vertical channel extending longitudinally therealong shaped to receive utilities therein through an outwardly opening side to facilitate vertical routing of utilities therein along a face of said frame.

8. A reconfigurable office partition as set forth in claim 7, wherein:

said second stile defines a wall track shaped to extend along an existing architectural wall in close proximity thereto, and including a pair of horizontally spaced-apart flanges forming a U-shaped channel that receives a side edge of said core panel.

9. A reconfigurable office partition as set forth in claim 8, wherein:

said at least two cross-members are disposed side-by-side relative to one another when assembled and including:

third and fourth cross-members disposed side-by-side relative to one another when assembled to define a gap therebetween within which said core panel is received.

10. A reconfigurable office partition as set forth in claim 9, wherein:

said wall track includes a pair of inwardly-extending sidewalls forming said flanges, each defining a vertical free edge, a side edge of said core panel being disposed between said sidewalls when assembled.

11. A reconfigurable office partition as set forth in claim 10, including:

fasteners for securing said cross-members to said sidewalls of said wall track during said on-site assembly.

12. A reconfigurable office partition as set forth in claim 11, wherein:

said wall track is configured to interconnect said variable width panel to an adjacent full width panel in an end-to-end configuration when in an assembled condition.

13. A reconfigurable office partition as set forth in claim 12, including:

at least one elongated retainer removably connected to said wall track and extending over and retaining a cut edge of said cover panel.

14. A reconfigurable office partition as set forth in claim 13, including:

a floor track; and a bracket configured to interconnect said wall track and said floor track during said on-site assembly.

15. A reconfigurable office partition as set forth in claim 14, wherein:

said wall track has a construction which permits cutting said wall track such that first and second portions thereof can be mounted to said core panel to form a contour closely following a non-planar existing architectural wall.

16. A reconfigurable office partition as set forth in claim 15, wherein:

said wall track includes a plurality of clearance holes for securing said variable width panel to a standard width panel.

17. A reconfigurable office partition as set forth in claim 15, including:

a ceiling track shaped to be supported on a ceiling;

a variable height panel support configured to extend between and connect with a top portion of said frame and said ceiling track when in an assembled condition; said panel support being vertically adjustable and including a lock which rigidly retains said panel support at a selected height.

18. A reconfigurable office partition as set forth in claim 17, wherein:

said cover panel has an upholstered exterior face.

19. A reconfigurable office partition as set forth in claim 1, including:

at least one elongated retainer removably connected to said wall track and extending over and retaining a cut edge of said cover panel.

20. A reconfigurable office partition system having a plurality of prefabricated standard width panels having prefabricated rigid panel frames interconnected to define a wall which extends along at least a portion of a predetermined wall length, wherein the balance of the predetermined wall length creates a space having a width less than the width of one of said standard width panels, said partition system including a variable width panel mounted in said space, comprising:

a frame having a knock-down construction for on-site assembly, including:

at least two rigid stiles disposed in a generally vertical assembled orientation along opposite sides of said space and said frame;

at least two rigid cross-members extending between said stiles in a vertically spaced apart, generally horizontal assembled orientation; said cross-members having a predetermined full width with a construction which permits said cross-members to be cut to a custom width during said on-site assembly to define a special width panel connected with at least one of said standard width panels and having a width commensurate with said space; and fasteners detachably connecting said cross-member with said stiles to define a pocket therebetween;

a core panel received in said pocket, and having a predetermined full width with a construction which permits said core panel to be cut to a custom width during said on-site assembly for use in said special width panel;

fasteners mounting said core panel in said frame; and at least one cover panel detachably mounted on said frame, and enclosing an associated portion of the same; said cover panel having a predetermined full width with a construction which permits said cover panel to be cut to a custom width during said on-site assembly for use in said special width panel.

21. A partition system as set forth in claim 20, wherein:

at least one of said stiles includes an inwardly projecting mounting flange defining at least a portion of said pocket.

22. A partition system as set forth in claim 21, wherein:

at least one of said stiles includes a vertical channel extending longitudinally therealong shaped to receive utilities therein through an outwardly opening side to facilitate vertical routing of utilities therein along a face of said frame.

23. A partition system as set forth in claim 22, wherein:

a first end of each cross-member is fixedly secured to a first one of said stiles prior to said on-site assembly to form a rigid frame piece with said first one of said stiles forming a side edge of said frame piece, said cross-members extending therefrom in a cantilevered manner to define opposite free ends thereby permitting each cross-member to be cut to a custom length during said on-site assembly.

24. A partition system as set forth in claim 23, wherein:

a second one of said stiles defines a wall track shaped to abut an existing architectural wall.

25. A partition system as set forth in claim 24, wherein:

said wall track includes a pair of inwardly-extending sidewalls, a side edge of said core panel being disposed between said sidewalls when assembled.

26. A partition system as set forth in claim 25, including:

a floor track shaped to be supported on a floor;

an adjustable height base support adapted to position said frame at a selected vertical position above said floor track during said on-site assembly to compensate for variations in the floor surface.

27. A partition system as set forth in claim 26, including:

a bracket configured to interconnect said wall track and said floor track during said on-site assembly.

28. A partition system as set forth in claim 27, including:

a ceiling track shaped to be supported on a ceiling;

a variable height panel support configured to extend between and connect with a top portion of said frame and said ceiling track when in an assembled condition; said panel support being vertically adjustable and including a lock which rigidly retains said panel support at a selected height.

29. A partition system as set forth in claim 28, wherein:

at least one elongated retainer removably connected to said wall track and extending over and retaining a cut edge of said cover panel.

30. A reconfigurable office partition having a plurality of prefabricated standard width panels interconnected to define a partition wall which extends along at least a portion of a predetermined wall length with the balance of the same defining a space having a width less than the width of one of the standard width panels; said partition including a variable width panel comprising:

a frame having a knock-down construction for on-site assembly, including:

at least two rigid stiles disposed in a generally vertical orientation along opposite sides of the space and said frame;

at least two rigid cross-members extending between said stiles in a vertically spaced apart, generally horizontal orientation; said cross-members having a predetermined full width with a construction which permits said cross-members to be cut to a custom width during said on-site assembly for use in a special width panel having a width commensurate with the space, and being adapted for connection with at least one of the standard width panels; and fasteners detachably connecting said cross-member with at least one of said stiles to define a pocket therebetween;

a core panel received in said pocket, and having a predetermined full width with a construction which permits said core panel to be cut to a custom width during said on-site assembly for use in said special width panel;

fasteners mounting said core panel in said frame; and at least one cover panel detachably mounted on said frame, and enclosing an associated portion of the same; said cover panel having a predetermined full width with a construction which permits said cover panel to be cut to a custom width during said on-site assembly for use in said special width panel.

31. A reconfigurable partition as set forth in claim 30, wherein:

at least one of said stiles includes an inwardly projecting mounting flange defining at least a portion of said pocket.

32. A reconfigurable partition as set forth in claim 31, wherein:

at least one of said stiles includes a channel extending longitudinally therealong shaped to receive utilities therein through an outwardly-opening side to facilitate routing utilities therein along a face of said frame.

33. A reconfigurable partition as set forth in claim 32, wherein:

a first end of each cross-member is fixedly secured to a first one of said stiles prior to said on-site assembly thereby permitting each cross-member to be cut to a custom length during said on-site assembly to define a free end that is opposite said first end.

34. A reconfigurable partition as set forth in claim 33, wherein:

a second one of said stiles defines a wall track shaped to abut an existing architectural wall.

35. A reconfigurable partition as set forth in claim 34, wherein:

said wall track includes a pair of inwardly-extending sidewalls, a side edge of said core panel being disposed between said sidewalls when assembled.

36. A reconfigurable partition as set forth in claim 35, including:

a floor track shaped to be supported on a floor;

an adjustable height base support positioning said frame at a selected vertical position above said floor track to compensate for variations in the floor surface.

37. A reconfigurable partition as set forth in claim 36, including:

a bracket interconnecting said wall track and said floor track.

38. A reconfigurable partition as set forth in claim 37, including:

a ceiling track shaped to be supported on a ceiling;

a variable height panel support configured to extend between and connect with a top portion of said frame and said ceiling track when in an assembled condition; said panel support being vertically adjustable and including a lock which rigidly retains said panel support at a selected height.

39. A reconfigurable partition as set forth in claim 38, wherein:

at least one elongated retainer removably connected to said wall track and extending over and retaining a cut edge of said cover panel.

40. A method for installing reconfigurable office partitions and the like, comprising:

providing a plurality of prefabricated standard width panels;

interconnecting the standard width panels to define a wall which extends along at least a portion of a predetermined wall length, wherein the balance of the predetermined wall length is less than the width of one of the standard width panels;

providing a variable width panel comprising a frame having a knock-down construction adapted for on-site assembly, and including:

at least two rigid stiles disposed in a generally vertical assembled orientation along opposite sides of said frame, and at least two rigid cross-members having a predetermined full width, and extending between the stiles in a vertically spaced apart, generally horizontal assembled orientation;

cutting the cross-members to a custom width during the on-site assembly for use in a special width panel that connects with the standard width panels;

fastening the cross-members to the stiles to define a pocket therebetween;

providing a core panel having a predetermined full width;

cutting the core panel to a custom width during the on-site assembly for use in the special width panel;

fastening the core panel in the pocket;

providing at least one cover panel having a predetermined full width;

cutting the cover panel to a custom width during the on-site assembly for use in the special width panel; and removably mounting the cover panel on the frame to enclose an associated portion of the same.

41. A method as set forth in claim 40, wherein:

said cross-members are fixedly secured to a selected one of said stiles prior to cutting said cross-members during said on-site assembly to form a prefabricated frame piece having a vertical stile and cross-members fixed thereto in a cantilevered manner to define free ends.

42. A method as set forth in claim 41, wherein:

said cross-members comprise at least four cross-members that are secured to opposite faces of said stiles in upper and lower side-by-side pairs to define a gap between each pair of side-by-side cross-members, said core panel being fastened to said frame and disposed within said gap.

43. A method as set forth in claim 40, wherein:

at least one of said stiles defines a wall track, and wherein said core panel is cut to define an edge corresponding to the contour of an existing architectural wall; the architectural wall having at least a portion extending at an angle relative to vertical; and including:

cutting said wall track to define first and second wall tracks;

installing said first and second wall tracks on said edge of said core panel.

44. A method as set forth in claim 43, wherein:

said cross-members are cut to lengths corresponding to said contour of said architectural wall.

45. A method for installing a variable width panel in a reconfigurable office partition of the type having a plurality of prefabricated standard width panels interconnected to define a wall which extends along at least a portion of a predetermined wall length, wherein the balance of the predetermined wall length is less than the width of one of the standard width panels;

providing a frame having a knock-down construction adapted for on-site assembly, and including:

at least two rigid stiles disposed in a generally vertical assembled orientation along opposite sides of said frame, and at least two upper rigid cross-members and at least two lower rigid cross-members, said upper and lower cross-members having a predetermined full width, said upper cross-members forming a horizontally spaced-apart upper pair and said lower members forming a horizontally spaced-apart lower pair, said upper and lower pairs extending between the stiles in a vertically spaced apart, generally horizontal assembled orientation;

cutting the cross-members to a custom width during the on-site assembly for use in a special width panel that connects with the standard width panels;

fastening the cross-members to the stiles to define a pocket therebetween;

providing a generally planar core panel having opposite side faces and a predetermined full width;

cutting the core panel to a custom width during the on-site assembly for use in the special width panel;

fastening the core panel in the pocket with the core panel extending between said cross-members forming said upper pair and between said cross-members forming said lower pair, such that an upper cross-member and a lower cross-member are disposed adjacent each opposite side face of said core panel;

providing at least one cover panel having a predetermined full width;

cutting the cover panel to a custom width during the on-site assembly for use in the special width panel; and removably mounting the cover panel on the frame to enclose an associated portion of the same.

46. A method as set forth in claim 45, wherein:

said cross-members are fixedly secured to a selected one of said stiles prior to cutting said cross-members during said on-site assembly.

47. A method as set forth in claim 46, wherein:

said cross-members are secured to opposite faces of said stiles.

48. A method as set forth in claim 47, wherein:

at least one of said stiles defines a wall track, and wherein said core panel is cut to define an edge corresponding to the contour of an existing architectural wall; the architectural wall having at least a portion extending at an angle relative to vertical; and including:

cutting said wall track to define first and second wall tracks;

installing said first and second wall tracks on said edge of said core panel.

49. A method as set forth in claim 48, wherein:

said cross-members are cut to lengths corresponding to said contour of said architectural wall.

50. A reconfigurable office partition having a plurality of prefabricated standard width panels interconnected to define a partition wall; said partition including a variable width panel comprising:

a frame having a knock-down construction adapted for on-site assembly, including:

at least two rigid stiles adapted to be disposed in a generally vertical assembled orientation along opposite sides of said frame to define a pocket therebetween;

a core panel shaped to be received in said pocket, and having a predetermined full width with a construction which permits said core panel to be cut to a custom width during said on-site assembly for use in said special width panel;

fasteners for mounting said core panel in said frame; and at least one cover panel configured to be detachably mounted on said frame, and enclose an associated portion of the same; said cover panel having a predetermined full width with a construction which permits said cover panel to be cut to a custom width during said on-site assembly for use in said special width panel.

51. A reconfigurable office partition as set forth in claim 50, including:

at least two rigid cross-members adapted to extend between said stiles in a vertically spaced-apart, generally horizontal assembled orientation; said cross-members having a predetermined full width with a construction which permits said cross-members to be cut to a custom width during said on-site assembly for use in a special width panel that is adapted for connection with the standard width panels; and fasteners for detachably connecting said cross-member with said stiles.

52. A reconfigurable office partition as set forth in claim 51, wherein:

said stiles include inwardly projecting mounting flanges defining at least a portion of said pocket.

53. A reconfigurable office partition as set forth in claim 52, wherein:

said core panel comprises a sheet of gypsum board.

54. A reconfigurable office partition as set forth in claim 52, wherein:

said core panel comprises a metal sheet.

55. A reconfigurable office partition as set forth in claim 53, wherein:

at least one of said stiles includes a channel extending longitudinally therealong shaped to receive utilities therein through an outwardly-opening side to facilitate routing utilities therein along a face of said frame.

56. A reconfigurable office partition as set forth in claim 55, wherein:

said second one of said stiles defines a wall track shaped to abut an existing architectural wall.

57. A reconfigurable office partition as set forth in claim 56, wherein:

said at least two cross-members comprise four cross-members disposed in upper and lower side-by-side pairs when assembled to define a gap therebetween within which said core panel is received.

58. A reconfigurable office partition as set forth in claim 57, including:

a floor track; and wherein:

said floor track includes an upwardly-extending flange extensibly engaging a lower portion of said frame when in an assembled condition to provide an acoustic barrier between adjacent office spaces.

59. A reconfigurable office partition as set forth in claim 58, wherein:

at least one elongated retainer removably connected to said wall track and extending over and retaining a cut edge of said cover panel.

60. A variable width panel kit for reconfigurable office partitions and the like of the type having a plurality of prefabricated standard width panels interconnected to define a partition wall; said variable width panel comprising:

a frame having a knock-down construction adapted for on-site assembly, including:

a stile adapted to be disposed in a generally vertical assembled orientation along a first side of said frame;

a wall track adapted to be disposed in a generally vertical assembled orientation along a second side of said frame to define a pocket between said stile and said wall track, said wall track being adapted for connection with the standard width panels;

a core panel shaped to be received in said pocket, and having a predetermined full width with a construction which permits said core panel to be cut to a custom width during said on-site assembly for use in said special width panel;

at least one cover panel configured to be detachably mounted on said frame, and enclose an associated portion of the same; said cover panel having a predetermined full width with a construction which permits said cover panel to be cut to a custom width during said on-site assembly for use in said special width panel; and an elongated retainer adapted to be removably connected to said wall track and extend therealong, said retainer having an outer portion extending over an edge portion of said cover panel to retain the same to said frame when in an assembled condition.

61. A variable width panel kit as set forth in claim 60, wherein:

said wall track includes a pair of flanges adapted to extend over a side edge of said core panel when assembled.

62. A variable width panel kit as set forth in claim 60, wherein:

said wall track defines a channel extending along a side face of the wall track, said retainer having an L-shaped cross section with a first leg adapted to be removably received within said channel, and a second leg adapted to extend over and retain a side edge of said cover panel.

63. A variable width panel kit as set forth in claim 62, including:

at least two rigid cross-members adapted to extend between said stiles in a vertically spaced-apart, generally horizontal assembled orientation; said cross-members having a predetermined full width with a construction which permits said cross-members to be cut to a custom width during said on-site assembly for use in a special width panel that is adapted for connection with the standard width panels; and fasteners for detachably connecting said cross-member with said stiles.

64. A variable width panel kit as set forth in claim 63, wherein:

said stiles include inwardly projecting mounting flanges defining at least a portion of said pocket.

65. A variable width panel kit as set forth in claim 64, wherein:

said core panel comprises a sheet of gypsum board.

66. A variable width panel kit as set forth in claim 65, wherein:

said core panel comprises a metal sheet.

67. A cover panel for covering a variable width panel frame, comprising:

a panel member defining a quadrilateral perimeter with an upper edge, a downwardly-extending flange defining a lower edge, said flange connected to said panel member and extending along said upper edge; said cover panel having a predetermined full width with a construction which permits said cover panel to be cut to a custom width during on-site assembly for covering at least a portion of the variable width panel frame; and a hanger having a pair of oppositely opening hooks, a first hook engaging said lower edge of said flange, and a second hook shaped to engage the variable width panel frame to support said cover panel adjacent a cut edge thereof.

68. A cover panel as set forth in claim 67, wherein:

said flange has a predetermined length, and said hanger includes a second pair of oppositely opening hooks shaped to engage a downwardly-extending flange having a different predetermined length.

69. A cover panel as set forth in claim 67, wherein:

said panel member has a wood construction, and said flange is formed by a bracket member secured to said panel member.

* * * * *

UNITED STATES PATENT AND TRADEMARK OFFICE

CERTIFICATE OF CORRECTION

PATENT NO. : 6,128,877
DATED : October 10, 2000
INVENTOR(S) : Steven F. Goodman et al.

It is certified that error appears in the above-identified patent and that said Letters Patent is hereby corrected as shown below:

Column 2,
Line 45, "use," should be -- user, --.

Column 3,
Line 43, "herefore" should be -- heretofore --.

Column 5,
Line 17, before "adapted" delete "for".
Line 23, "general" should be -- generally --.
Line 35, "enclosed" should be -- enclose --.
Line 61, "enclosed" should be -- enclose --.

Column 7,
Line 34, after "along" insert -- the line --.

Column 9,
Line 66, before "preferably" insert -- is --.

Column 10,
Line 8, after "best" delete "in".
Line 21, "in" should be -- and --.

Column 13,
Line 64, "panels" should be -- panel --.

Column 14,
Line 2, "panels frame" should be -- panel frames --.

Column 17, claim 29,
Line 55, "wherein:" should be -- including: --.

Column 19, claim 39,
Line 9, "wherein:" should be -- including: --.

UNITED STATES PATENT AND TRADEMARK OFFICE

CERTIFICATE OF CORRECTION

PATENT NO. : 6,128,877
DATED : October 10, 2000
INVENTOR(S) : Steven F. Goodman et al.

It is certified that error appears in the above-identified patent and that said Letters Patent is hereby corrected as shown below:

Column 22,
Line 7, "wherein:" should be -- including: --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*